US009620935B2

(12) United States Patent
Kobayashi et al.

(10) Patent No.: US 9,620,935 B2
(45) Date of Patent: Apr. 11, 2017

(54) SPARK PLUG

(71) Applicant: NGK SPARK PLUG CO., LTD., Nagoya-shi, Aichi (JP)

(72) Inventors: Tsutomu Kobayashi, Inazawa (JP); Keiji Ozeki, Konan (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/025,675

(22) PCT Filed: Oct. 10, 2014

(86) PCT No.: PCT/JP2014/077248

§ 371 (c)(1),
(2) Date: Mar. 31, 2016

(87) PCT Pub. No.: WO2015/053399

PCT Pub. Date: Apr. 16, 2015

(65) Prior Publication Data

US 2016/0218487 A1 Jul. 28, 2016

(30) Foreign Application Priority Data

Oct. 11, 2013 (JP) ..... 2013-213840

(51) Int. Cl.
*H01T 13/20* (2006.01)
*H01T 13/36* (2006.01)

(52) U.S. Cl.
CPC ..... *H01T 13/20* (2013.01); *H01T 13/36* (2013.01)

(58) Field of Classification Search
CPC ..... H01T 13/20; H01T 13/36
See application file for complete search history.

(56) References Cited

U.S. PATENT DOCUMENTS

2008/0136305 A1* 6/2008 Kadowaki ..... H01T 13/38 313/141
2012/0267995 A1 10/2012 Shimamura et al. ..... 313/143
(Continued)

FOREIGN PATENT DOCUMENTS

JP 2012-069251 A 4/2012 ..... H01T 13/20
WO WO 2011/118087 A1 9/2011 ..... F02P 13/00

OTHER PUBLICATIONS

International Search Report issued in corresponding International Patent Application No. PCT/JP2014/077248, dated Nov. 11, 2014.

*Primary Examiner* — Donald Raleigh
(74) *Attorney, Agent, or Firm* — Kusner & Jaffe

(57) ABSTRACT

A packing between an insulator and a metal shell of a spark plug. A length between a first position of a contact portion of the packing and the insulator and a second position of a contact portion of the packing and the insulator parallel to an axial line direction is set as a first length. In the case where a load perpendicular to the axial line direction is applied to the second position, a ratio of stress at a surface position that is a position on a surface of the insulator to stress at the first position is set as a stress ratio. In a range of the surface position where the stress ratio is 0.8 or more to 1.15 or less, a length in a continuous range from the first position toward a front end side parallel to the axial line direction is set as a second length. A ratio of the second length to the first length is 0.7 or more.

6 Claims, 7 Drawing Sheets

(56) References Cited

U.S. PATENT DOCUMENTS

| | | | | |
|---|---|---|---|---|
| 2013/0015756 | A1* | 1/2013 | Yamada | H01T 13/36<br>313/143 |
| 2013/0147339 | A1* | 6/2013 | Burrows | H01T 13/20<br>313/143 |
| 2015/0188294 | A1* | 7/2015 | Nishida | H01B 3/12<br>174/110 R |

* cited by examiner (A)

(B)

SPARK PLUG

RELATED APPLICATIONS

This application is a National Stage of International Application No. PCT/JP2014/077248 filed Oct. 10, 2014, which claims the benefit of Japanese Patent Application No. 2013-213840, filed Oct. 11, 2013.

FIELD OF THE INVENTION

This disclosure relates to a spark plug.

BACKGROUND OF THE INVENTION

Conventionally, a spark plug has been used for an internal combustion engine. As the spark plug, for example, a spark plug that includes a center electrode, an insulator, a metal shell, and a packing has been used. The center electrode extends in an axial line direction. The insulator has an axial hole extending in the axial line direction. The center electrode is arranged at a front end side of the axial hole. The metal shell is arranged at an outer periphery of the insulator. The packing is arranged between the insulator and the metal shell. As the insulator, for example, an insulator that includes a step part and an insulator nose portion has been used. The step part has an outer diameter reduced to the front end side. The insulator nose portion extends to the front end at the front end side of the step part. The packing is sandwiched between the step part of the insulator and the metal shell. Here, there has been proposed the following technique. To reduce breakage of the insulator, a curved surface portion is disposed between the step part of the insulator and the insulator nose portion. In addition to the step part of the insulator, the packing is also brought into contact with a site at the front end side with respect to an intermediate portion of the curved surface portion.

SUMMARY OF THE INVENTION

To improve design freedom of an internal combustion engine, it recently has become desirable to have a spark plug with a small diameter. If the small-diameter spark plug results in the insulator having a small diameter, the insulator is possibly likely to be broken.

This disclosure provides a new technique to reduce a possibility of breaking the insulator.

This disclosure, for example, discloses the following application examples.

Application Example 1

In accordance with a first aspect of the present invention, there is provided a spark plug that includes a center electrode, an insulator, a metal shell, and a packing. The center electrode extends in an axial line direction. The insulator includes an axial hole extending in the axial line direction. The center electrode is arranged at a front end side of the axial hole. The insulator includes an outer-diameter-contracted portion and a nose portion. The outer-diameter-contracted portion has an outer diameter decreased toward the front end side in the axial line direction. The nose portion is a part disposed at a front end side of the outer-diameter-contracted portion. The metal shell is arranged at an outer periphery of the insulator. The metal shell includes an inner-diameter-contracted portion. The inner-diameter-contracted portion has an internal diameter decreased toward the front end side in the axial line direction. The packing is arranged between the outer-diameter-contracted portion of the insulator and the inner-diameter-contracted portion of the metal shell. Assuming that in a contact portion of the packing and the insulator, a position at a most front end side is set as a first position, in a surface of the nose portion of the insulator, a position where a length from a front end of the insulator parallel to the axial line direction is 1 mm is set as a second position, a length between the first position and the second position parallel to the axial line direction is set as a first length, in a case where a load perpendicular to the axial line direction is applied to the second position in a state where the insulator is secured at the first position of the insulator and the front end of the insulator is a free end, a ratio of stress at a surface position that is a position on a surface of the insulator to stress at the first position is set as a stress ratio, and in a range of the surface position where the stress ratio is 0.8 or more to 1.15 or less, a length in a continuous range from the first position toward a front end side parallel to the axial line direction is set as a second length, a ratio of the second length to the first length is 0.7 or more.

This configuration reduces a variation in stress at the surface of the insulator compared with the case where the ratio of the second length to the first length is less than 0.7. Accordingly, a possibility of breaking the insulator can be reduced.

Application Example 2

In accordance with a second aspect of the present invention, there is provided a spark plug according to the application example 1, wherein the insulator has an outer diameter of 3.5 mm or less at the second position.

This configuration allows reducing a possibility of breaking the insulator due to vibration.

Application Example 3

In accordance with a third aspect of the present invention, there is provided the spark plug according to the application example 1 or 2, wherein a nose portion includes a cylinder portion forming a front end side part of the nose portion. The cylinder portion has a constant outer diameter. A length from a rear end of the cylinder portion to the front end of the insulator parallel to the axial line direction is 3.5 mm or less.

This configuration allows reducing a possibility of fracturing the insulator at a part near the cylinder portion.

Application Example 4

In accordance with a fourth aspect of the present invention, there is provided a spark plug according to any one of the application examples 1 to 3, wherein a part of the front end side of the nose portion is arranged on a front end side with respect to a front end of the metal shell. A projection area when projecting a part of the nose portion arranged on a front end side with respect to the front end of the metal shell in a direction perpendicular to the axial line direction is 8.7 $mm^2$ or less.

This configuration allows reducing a possibility of fracturing the nose portion.

Application Example 5

In accordance with a fifth aspect of the present invention, there is provided a spark plug according to any one of the application examples 1 to 4, wherein the metal shell includes a thread portion for mounting. A nominal diameter of the thread portion is M10 or less.

This configuration allows reducing a possibility of breaking the insulator when using the thin spark plug whose nominal diameter of the thread portion is M10 or less.

Application Example 6

In accordance with a sixth aspect of the present invention, there is provided a spark plug according to any one of the application examples 1 to 5, wherein the nose portion includes a cylinder portion forming the front end side part of the nose portion. The cylinder portion has a constant outer diameter. The part of the front end side of the nose portion is arranged on the front end side with respect to the front end of the metal shell. Assuming that a length from the rear end of the cylinder portion to the front end of the insulator parallel to the axial line direction is denoted as Ds1, a section modulus of the insulator at the first position is denoted as Z1, a section modulus of the insulator at the rear end of the cylinder portion is denoted as Z2, a length from the first position to the front end of the insulator parallel to the axial line direction is denoted as L4, and a length of a part of the nose portion positioned on a front end side with respect to the front end of the metal shell parallel to the axial line direction is denoted as De, following relational expressions (1), (2), and (3) are met.

$$Z1/Z2>3.5 \quad (1)$$

$$Ds1>2 \text{ mm} \quad (2)$$

$$Ds1<Ap\times(Z1/Z2)^{Bp} \quad (3)$$

Here, Ap=0.07+0.986×L4−0.268×De

Bp=−0.832−0.014×L4+0.099×De

Units of Ds1, L4, and De are mm.

This configuration can improve the anti-fouling characteristics or performance and the breaking resistance.

The present invention can be achieved by various forms, for example, can be achieved in a form of a spark plug, an internal combustion engine on which the spark plug is mounted, or a similar form.

DETAILED DESCRIPTION OF THE PREFERRED EMBODIMENTS

A. Embodiment

Figure 1:
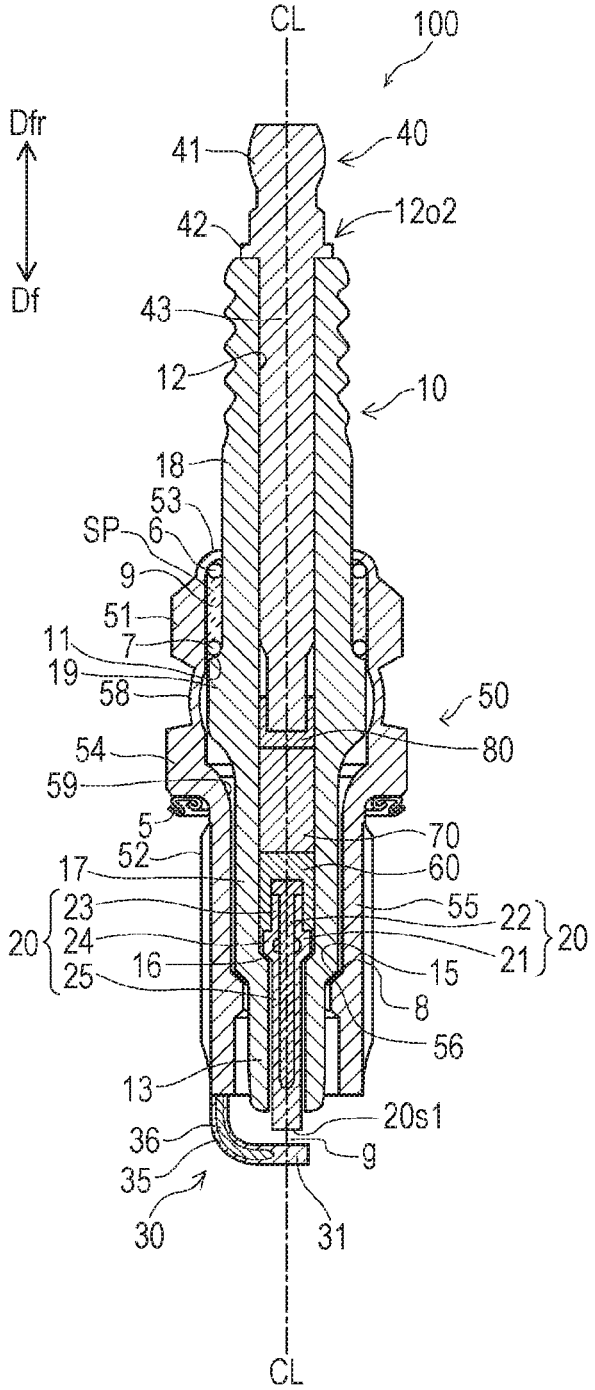
FIG. 1 is a sectional view of a spark plug 100 of an embodiment.

FIG. 1 is a sectional view of a spark plug 100 of an embodiment. A line CL shown in the drawing denotes the central axis of the spark plug 100. The cross section shown in the drawing is a cross section including the central axis CL. Hereinafter, the central axis CL is also referred to as an "axial line CL" and the direction parallel to the central axis CL is also referred to as an "axial line direction." The radial direction of a circle around the central axis CL is also referred to simply as a "radial direction" and the direction of the circumference of the circle around the central axis CL is also referred to as a "circumferential direction." Among directions parallel to the central axis CL, the downward direction in FIG. 1 is referred to as a front end direction Df while the upward direction is also referred to as a rear end direction Dfr. The front end direction Df is the direction from a terminal metal fitting 40 to electrodes 20 and 30 described later. The front end direction Df side in FIG. 1 is referred to as the front end side of the spark plug 100. The rear end direction Dfr side in FIG. 1 is referred to as the rear end side of the spark plug 100.

The spark plug 100 includes an insulator 10 (hereinafter referred to also as a "ceramic insulator 10"), the center electrode 20, the ground electrode 30, the terminal metal fitting 40, a metal shell 50, a conductive first seal portion 60, a resistor 70, a conductive second seal portion 80, a front-end-side packing 8, a talc 9, a first rear end side packing 6, and a second rear end side packing 7.

The insulator 10 is an approximately cylindrically-shaped member with a through hole 12 (hereinafter referred to also as an "axial hole 12"). The through hole 12 extends along the central axis CL so as to pass through the insulator 10. The insulator 10 is formed by sintering alumina (another insulating material can also be used). The insulator 10 includes a nose portion 13, a first outer-diameter-contracted portion 15, a front-end-side trunk portion 17, a collar portion 19, a second outer-diameter-contracted portion 11, and a rear-end-side trunk portion 18, each of which is arranged from the front end side toward the rear end side in this order.

The collar portion 19 is the largest outer diameter part of the insulator 10. The outer diameter of the first outer-diameter-contracted portion 15, which is disposed at the front end side with respect to the collar portion 19, gradually decreases from the rear end side toward the front end side. In the vicinity (the front-end-side trunk portion 17 in the example of FIG. 1) of the first outer-diameter-contracted portion 15 of the insulator 10, an inner-diameter-contracted portion 16 is formed. The inner diameter of the inner-diameter-contracted portion 16 gradually decreases from the rear end side toward the front end side. The outer diameter of the second outer-diameter-contracted portion 11, which is disposed at the rear end side with respect to the collar portion 19, gradually decreases from the front end side toward the rear end side.

Into the front end side of the through hole 12 of the insulator 10, the center electrode 20 is inserted. The center electrode 20 is a rod-shaped member extending along the central axis CL. The center electrode 20 includes an electrode base material 21 and a core material 22 buried inside of the electrode base material 21. The electrode base material 21 is, for example, formed using Inconel ("INCONEL" is a registered trademark), which is an alloy containing nickel as a main constituent. The core material 22 is formed with a material having higher thermal conductivity (for example, an alloy containing copper) than the electrode base material 21.

Focusing on an external appearance configuration of the center electrode 20, the center electrode 20 includes a nose portion 25, a collar portion 24, and a head 23. The nose portion 25 forms an end on the front end direction Df side.

The collar portion 24 is disposed on the rear end side of the nose portion 25. The head 23 is disposed on the rear end side of the collar portion 24. The head 23 and the collar portion 24 are arranged in the through hole 12. A surface on the front end direction Df side of the collar portion 24 is supported by the inner-diameter-contracted portion 16 of the insulator 10. A part on the front end side of the nose portion 25 is exposed to the outside of the through hole 12 on the front end side of the insulator 10.

The terminal metal fitting 40 is inserted into the rear end side of the through hole 12 of the insulator 10. The terminal metal fitting 40 is formed using a conductive material (for example, a metal such as a low-carbon steel). On a surface of the terminal metal fitting 40, a metal layer is possibly formed for corrosion proof. For example, a Ni layer is formed by plating. The terminal metal fitting 40 includes a collar portion 42, a plug cap installation portion 41, and a nose portion 43. The plug cap installation portion 41 forms the part on the rear end side with respect to the collar portion 42. The nose portion 43 forms the part on the front end side with respect to the collar portion 42. The plug cap installation portion 41 is exposed to the outside of the through hole 12 on the rear end side of the insulator 10. The nose portion 43 is inserted into the through hole 12 of the insulator 10.

In the through hole 12 of the insulator 10, between the terminal metal fitting 40 and the center electrode 20, the resistor 70 for reducing electrical noise is disposed. The resistor 70 is formed of a composition containing glass particles (for example, $B_2O_3$—$SiO_2$-based glass) as a main constituent, ceramic particles other than glass (for example, $TiO_2$), and a conductive material (for example, metal such as Mg and carbon particles).

In the through hole 12, between the resistor 70 and the center electrode 20, the first seal portion 60 is arranged. Between the resistor 70 and the terminal metal fitting 40, the second seal portion 80 is disposed. As a result, the center electrode 20 is electrically connected to the terminal metal fitting 40 via the resistor 70 and the seal portions 60 and 80. The seal portions 60 and 80, for example, contain the glass particles similar to the resistor 70 and metal particles (such as Cu and Fe). The use of the seal portions 60 and 80 stabilizes a contact resistance among laminated members 20, 60, 70, 80, and 40, allowing stabilizing a resistance value between the center electrode 20 and the terminal metal fitting 40.

The metal shell 50 is an approximately cylindrically-shaped member with a through hole 59, which extends along the central axis CL so as to pass through the metal shell 50. The metal shell 50 is formed using a low-carbon steel material (another conductive material (for example, a metallic material) can also be used). On the surface of the metal shell 50, the metal layer for corrosion proof is possibly obtained. For example, the Ni layer is formed by plating. The insulator 10 is inserted into the through hole 59 of the metal shell 50. The metal shell 50 is secured to the outer periphery of the insulator 10. On the front end side of the metal shell 50, the front end (in this embodiment, the part on the front end side of the nose portion 13) of the insulator 10 is exposed to the outside of the through hole 59. On the rear end side of the metal shell 50, the rear end (in this embodiment, the part on the rear end side of the rear-end-side trunk portion 18) of the insulator 10 is exposed to the outside of the through hole 59.

The metal shell 50 includes a trunk portion 55, a seat portion 54, a deformed portion 58, a tool engagement portion 51, and a crimp portion 53 that are arranged from the front end side toward the rear end side in this order. The seat portion 54 is a flanged part. At the front end side of the seat portion 54, the trunk portion 55 is disposed. The outer diameter of the trunk portion 55 is smaller than the outer diameter of the seat portion 54. At the outer peripheral surface of the trunk portion 55, a thread portion 52 is formed. The thread portion 52 is screwed with a mounting hole of the internal combustion engine (for example, a gasoline engine). A nominal diameter of the thread portion 52 is 10 mm (M10). Between the seat portion 54 and the thread portion 52, an annular gasket 5 is fitted. The gasket 5 is formed by folding a metal plate.

The metal shell 50 includes an inner-diameter-contracted portion 56. The inner-diameter-contracted portion 56 is arranged on the front end direction Df side with respect to the deformed portion 58. The internal diameter of the inner-diameter-contracted portion 56 gradually decreases from the rear end side toward the front end side. Between the inner-diameter-contracted portion 56 of the metal shell 50 and the first outer-diameter-contracted portion 15 of the insulator 10, the front-end-side packing 8 is sandwiched. The front-end-side packing 8 is made of steel, and is an O-shaped ring (another material (for example, a metallic material such as copper) can also be adopted).

On the rear end side of the seat portion 54, the deformed portion 58 is disposed. The deformed portion 58 has a wall thickness thinner than that of the seat portion 54. The deformed portion 58 is deformed such that the center portion projects toward the outside in the radial direction (the direction away from the central axis CL). On the rear end side of the deformed portion 58, the tool engagement portion 51 is disposed. The shape of the tool engagement portion 51 is a shape (for example, a hexagonal prism) with which a spark plug wrench is engaged. On the rear end side of the tool engagement portion 51, the crimp portion 53 is disposed. The crimp portion 53 has a wall thickness thinner than that of the tool engagement portion 51. The crimp portion 53 is arranged on the rear end side with respect to the second outer-diameter-contracted portion 11 of the insulator 10 so as to form the rear end (namely, the end on the rear end direction Dfr side) of the metal shell 50. The crimp portion 53 is flexed to radially inside.

On the rear end side of the metal shell 50, between the inner peripheral surface of the metal shell 50 and the outer peripheral surface of the insulator 10, an annular space SP is formed. In this embodiment, this space SP is a space surrounded by the crimp portion 53 and the tool engagement portion 51 of the metal shell 50 and the second outer-diameter-contracted portion 11 and the rear-end-side trunk portion 18 of the insulator 10. On the rear end side within this space SP, the first rear end side packing 6 is arranged. On the front end side within this space SP, the second rear end side packing 7 is arranged. In this embodiment, these rear end side packings 6 and 7 are C-shaped rings made of steel (another material can also be adopted). Between the two rear end side packings 6 and 7 within the space SP, the powders of the talc 9 are filled up.

During manufacture of the spark plug 100, the crimp portion 53 is crimped so as to be folded to the inside. Then, the crimp portion 53 is pressed toward the front end direction Df side. Accordingly, the deformed portion 58 is deformed, and the insulator 10 is pressed toward the front end side via the packings 6 and 7 and the talc 9 within the metal shell 50. The front-end-side packing 8 is pressed between the first outer-diameter-contracted portion 15 and the inner-diameter-contracted portion 56 to seal between the metal shell 50 and the insulator 10. The above-described configuration suppresses gas in the combustion chamber of the internal combustion engine from passing through between the metal shell 50 and the insulator 10 and then leaking to the outside. The metal shell 50 is secured to the insulator 10.

The ground electrode 30 is sealed to the front end (that is, the end on the front end direction Df side) of the metal shell 50. In this embodiment, the ground electrode 30 is a rod-shaped electrode. The ground electrode 30 extends from the metal shell 50 toward the front end direction Df, is bent toward the central axis CL, and reaches a front end portion 31. The front end portion 31 forms a gap g with a front end surface 20*s*1 (the surface 20*s*1 on the front end direction Df side) of the center electrode 20. The ground electrode 30 is sealed to the metal shell 50 to be electrically continued (for example, by laser beam welding). The ground electrode 30 includes a base material 35 and a core portion 36. The base material 35 forms the surface of the ground electrode 30. The core portion 36 is buried within the base material 35. The base material 35 is formed, for example, using Inconel. The core portion 36 is formed using a material (for example, pure copper) with higher thermal conductivity than that of the base material 35.

Figure 2:
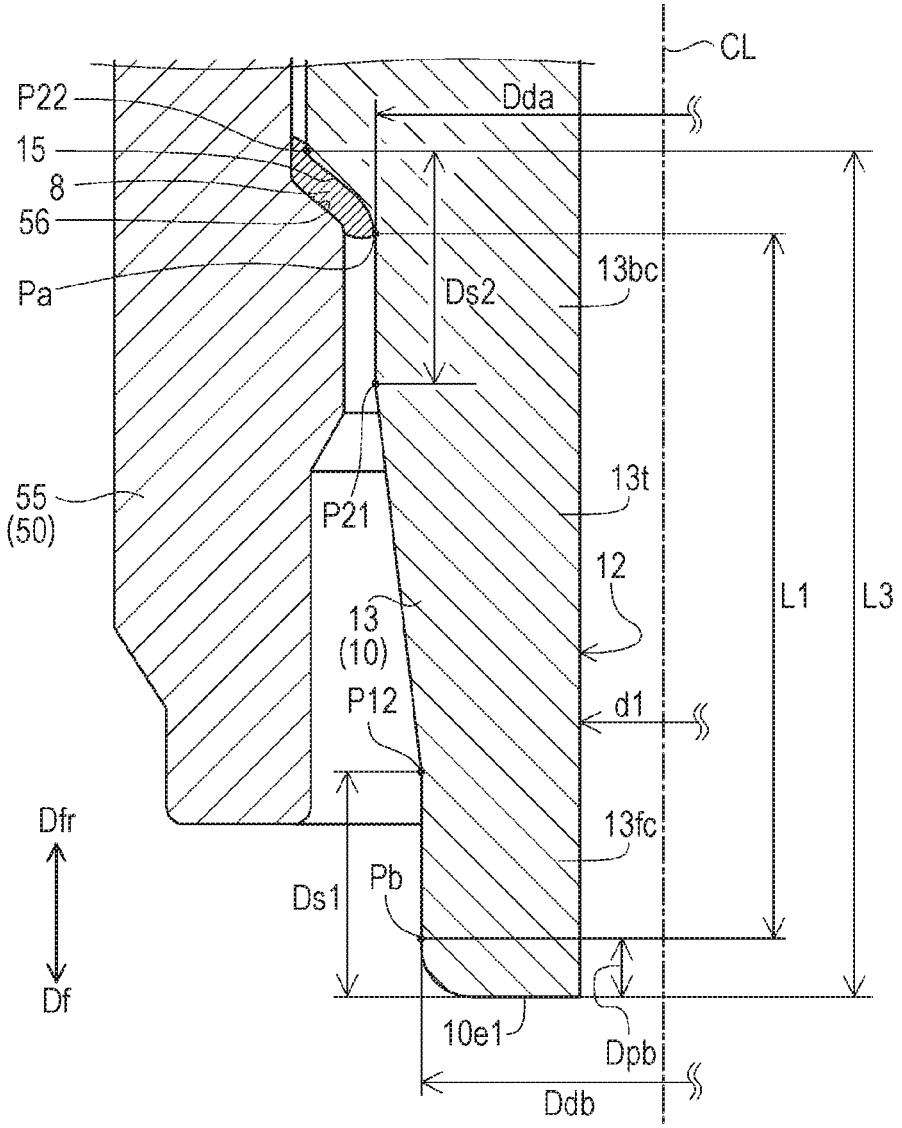
FIG. 2 is an explanatory view showing a configuration of an insulator 10.

FIG. 2 is an explanatory view of parameters Ddb, Dda, Ds1, Ds2, L1, L3, and d1 showing the configuration of the insulator 10. The drawing shows a partial sectional view of the metal shell 50 and the insulator 10. Specifically, the drawing shows one side part viewed from the central axis CL on the front end direction Df side from a part in contact with the front-end-side packing 8 in the cross section including the central axis CL.

The drawing shows an exemplary configuration of the nose portion 13. The shown nose portion 13 includes a front cylinder portion 13*fc*, a tapered portion 13*t*, and a rear cylinder portion 13*bc* arranged from the front end side toward the rear end side in this order. The front cylinder portion 13*fc* is a part on the front end direction Df side in the nose portion 13. The front cylinder portion 13*fc* is a part having an approximately cylindrical shape with constant outer diameter. A corner at the front end of the front cylinder portion 13*fc* is chamfered. The rear cylinder portion 13*bc* is a part on the rear end direction Dfr side in the nose portion 13. The rear cylinder portion 13*bc* is a part having an approximately cylindrical shape with constant outer diameter. The outer diameter of the rear cylinder portion 13*bc* is larger than the outer diameter of the front cylinder portion 13*fc*. The tapered portion 13*t* is a part between the front cylinder portion 13*fc* and the rear cylinder portion 13*bc*. The tapered portion 13*t* is a part whose outer diameter gradually decreases toward the front end direction Df. The front cylinder portion 13*fc* is possibly omitted. In this case, the front end of the tapered portion 13*t* forms the front end of the nose portion 13. The rear cylinder portion 13*bc* is possibly omitted. In this case, the rear end of the tapered portion 13*t* forms the rear end of the nose portion 13.

The drawing shows a first position Pa, a second position Pb, a first length L1, the end portion diameter Ddb, the base diameter Dda, an end portion length Ds1, and a base length Ds2. The first position Pa is positioned at the most front end side in a contact portion of the insulator 10 and the front-end-side packing 8. That is, the first position Pa is positioned at the most front end direction Df side in the part secured (namely, supported) by another member in the surface of the insulator 10. The first position Pa is positioned on the surface of the nose portion 13. However, the first position Pa may be positioned on the surface of the first outer-diameter-contracted portion 15.

The second position Pb is a position on the surface of the nose portion 13 of the insulator 10 where a length from a front end 10*e*1 of the insulator 10 parallel to the central axis CL is a predetermined length Dpb. The following uses 1 mm as the predetermined length Dpb. The bending test, which will be described later, applies to this second position Pb a force in the direction toward the central axis CL perpendicular to the central axis CL.

The first length L1 is a length between the first position Pa and the second position Pb and is parallel to the central axis CL. The third length L3 is a length between a rear end P22 of the first outer-diameter-contracted portion 15 of the insulator 10 and the front end 10*e*1 of the insulator 10 and is parallel to the central axis CL. Hereinafter, the third length L3 is also referred to as an "insulator nose length L3." The internal diameter d1 is a diameter of the through hole 12. In this embodiment, the internal diameter d1 is the identical across the entire range from the first position Pa to the second position Pb.

The end portion diameter Ddb is the outer diameter of the insulator 10 at the second position Pb. The base diameter Dda is the outer diameter of the insulator 10 at the first position Pa.

The end portion length Ds1 is a length between the front end 10*e*1 of the nose portion 13 and a rear end P12 of the front cylinder portion 13*fc* of the nose portion 13 and is parallel to the central axis CL.

The base length Ds2 is a length between the rear end P22 of the first outer-diameter-contracted portion 15 of the insulator 10 and a front end P21 of the rear cylinder portion 13*bc* of the nose portion 13 and is parallel to the central axis CL. This base length Ds2 is a total value of the length of the first outer-diameter-contracted portion 15 and the length of the rear cylinder portion 13*bc*.

Figure 3:
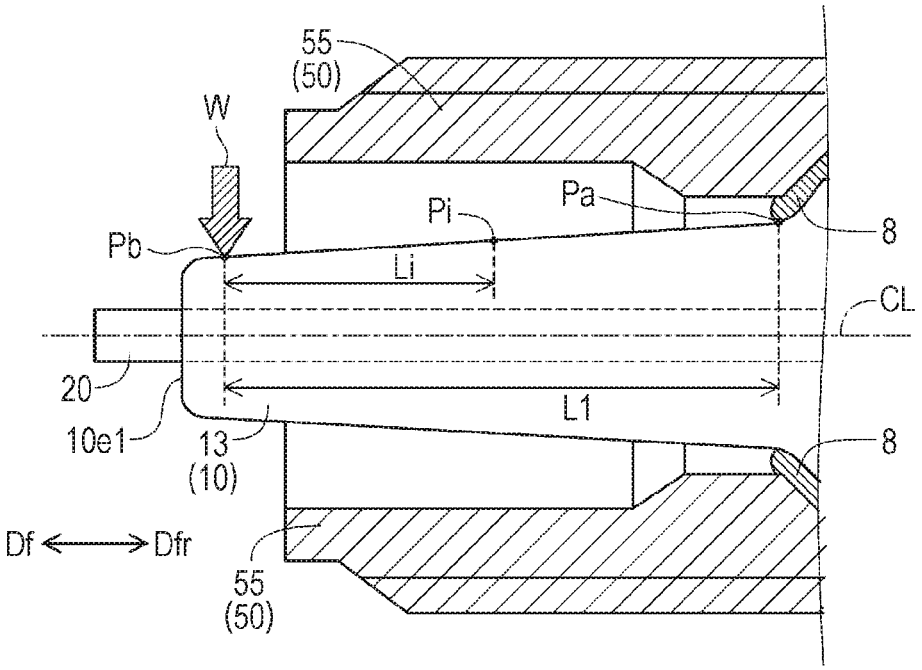
FIG. 3 includes explanatory views of a bending test and stress.
Figure 3:
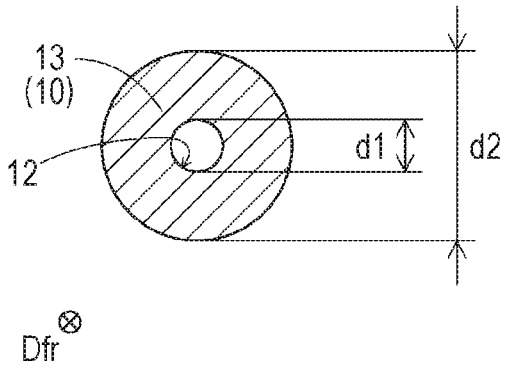

FIG. 3 includes explanatory views describing stress at the surface of the nose portion 13 of the insulator 10. The drawing shows a cross section including the central axis CL of the metal shell 50 and the front-end-side packing 8 and an external appearance of the insulator 10 and the center electrode 20. The spark plug 100 is installed at a mounting hole (not shown) of an internal combustion engine. In this state, the insulator 10 is secured at the first position Pa. The front end 10*e*1 of the insulator 10 is a free end. A part of the insulator 10 on the front end direction Df side with respect to the first position Pa (here, the nose portion 13) is exposed to the combustion chamber of the internal combustion engine. When burning air-fuel mixture in the combustion chamber of the internal combustion engine, various forces are possibly applied to the nose portion 13. For example, to the part close to the second position Pb, a force W in the radial direction toward the central axis CL is possibly applied. This direction of the force W is a direction perpendicular to the central axis CL and toward the central axis CL.

If applying such force W to the second position Pb, stress is generated at the surface of the nose portion 13. Here, the following describes stress at a position of interest Pi shown in FIG. 3(A). The position of interest Pi is a position within the range from the first position Pa to the second position Pb on the surface of the nose portion 13. In the drawing, a length of interest L1 is a length between the second position Pb and the position of interest Pi and is parallel to the central axis CL. FIG. 3(B) shows a cross section perpendicular to the central axis CL of the nose portion 13 at the position of interest Pi. An internal diameter d1 indicates an internal diameter of the nose portion 13 at the position of interest Pi (that is, a diameter of the through hole 12). An outer diameter d2 indicates an outer diameter of the nose portion 13 at the position of interest Pi.

Stress Sti at the position of interest Pi can be calculated in accordance with the following calculating formulas (1A) to (1C). These calculating formulas (1A) to (1C) are calculating formulas for stress in the case of a cantilever. The calculating formulas (1A) to (1C) are calculating formulas for stress in the case where the fixed end with the cross-sectional shape shown in FIG. 3(B) receives the force W applied to a position away from the fixed end by the length of interest Li. When the force W is applied to the second position Pb while the insulator 10 is secured at the first position Pa, a deformation of the insulator 10 is sufficiently small. Therefore, the stress Sti at the position of interest Pi can be approximately calculated by the calculating formulas (1A) to (1C) in the case where the insulator 10 is secured at the position of interest Pi.

$$Sti=M/Z \quad (1A)$$

$$M=Wf\times Li \quad (1B)$$

$$Z=(\pi\times(d2^4-d1^4))/(32\times d2) \quad (1C)$$

Meaning of each parameter is as follows.

Sti: stress Sti, M: moment, Z: section modulus,

Wf: strength of force W, Li: length of interest Li, π: ratio of the circumference of a circle to its diameter, d1: internal diameter d1, d2: outer diameter d2

Figure 4:
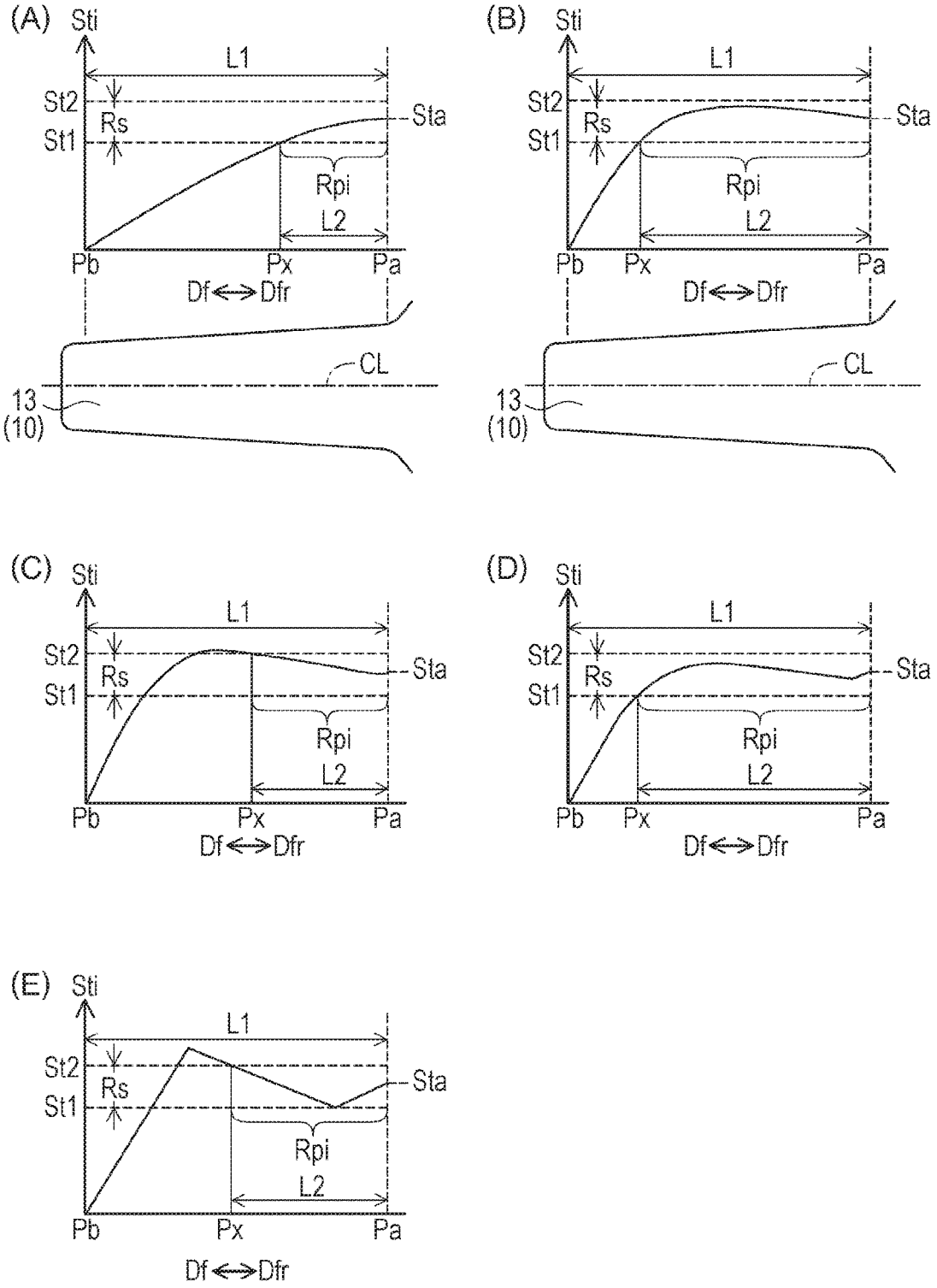
FIG. 4 includes graphs showing exemplary distributions of stress Sti.

FIG. 4 includes graphs showing exemplary distributions of the stress Sti. The horizontal axis indicates the position of interest Pi, and the perpendicular axis indicates the stress Sti. The range of the position of interest Pi is a range from the first position Pa to the second position Pb. FIGS. 4(A) to 4(E) each show the exemplary distributions of the stress Sti obtained from the insulators 10 of mutually different configurations (at least one of the dimensions and the shape). FIGS. 4(A) and 4(B) show the exemplary distributions of omitting the front cylinder portion 13*fc* (FIG. 2) and the rear cylinder portion 13*bc*. FIGS. 4(C) to 4(E) show the exemplary distributions of the insulators 10 including the front cylinder portion 13*fc* and the rear cylinder portion 13*bc* (not shown).

In the drawing, reference stress Sta indicates the stress Sti at the first position Pa. Lower limit stress St1 and upper limit stress St2 indicate a lower limit and an upper limit of a range including the reference stress Sta. Hereinafter, a range Rs of the stress Sti equal to or more than the lower limit stress St1 and equal to or less than the upper limit stress St2 is referred to as the allowable range Rs. Here, the lower limit stress St1 is 0.8 times of the reference stress Sta. The upper limit stress St2 is 1.15 times of the reference stress Sta. The stress Sti being within the allowable range Rs suggests that a ratio of the stress Sti to the reference stress Sta, "Sti/Sta", is 0.8 or more to 1.15 or less.

The drawing shows a consecutive range Rpi of the position of interest Pi where the stress Sti is in the allowable range Rs (hereinafter referred to as the "stable range Rpi"). This stable range Rpi is the widest range expanding from the first position Pa toward the front end direction Df side. In the drawing, a front end position Px indicates a front end position of this stable range Rpi. A second length L2 is a length of this stable range Rpi and is parallel to the central axis CL.

As shown in FIGS. 4(A) to 4(E), the distribution of the stress Sti possibly changes according to the configuration (for example, the dimensions) of the insulator 10 variously. In the example of FIG. 4(A), compared with the example of FIG. 4(B), the stress Sti concentrates on the narrow range Rpi near the first position Pa. Thus, in the case where the stress Sti concentrates on the narrow range, the insulator 10 is possibly likely to be broken within the range. Therefore, it is inferred that configuring the insulator 10 so as to have the wide stable range Rpi allows suppressing a break of the insulator 10. As an index representing the largeness of the stable range Rpi, a ratio of the second length L2 to the first length L1 can be used. From a perspective of suppressing the break of the insulator 10, this ratio (L2/L1) is preferably wide. The second length L2 can be calculated using a stress ratio Sti/Sta, which is calculated based on the above-described calculating formulas (1A) to (1C).

B. First Evaluation Test

The following describes the first evaluation test using samples of the spark plugs 100. As the first evaluation test, the "bending test" and a "vibration test" were conducted on the insulators 10. The following Table 1 shows configurations of the samples and the evaluation results.

TABLE 1

| | End Portion | Base | End Portion | Base | | Bending Test | | | |
|---|---|---|---|---|---|---|---|---|---|
| No. | Diameter Ddb (mm) | Diameter Dda (mm) | Length Ds1 (mm) | Length Ds2 (mm) | Ratio L2/L1 | Breaking Load (N) | Broken Portion | Evaluation | Vibration Test Evaluation |
| A-1 | 2.9 | 4.7 | 0 | 0 | 0.68 | 237 | Bb | B | B |
| A-2 | 2.9 | 5.2 | 0 | 0 | 0.78 | 340 | Ba | A | A |
| A-3 | 3.2 | 4.7 | 0 | 0 | 0.56 | 246 | Ba | A | B |
| A-4 | 3.2 | 5.2 | 0 | 0 | 0.68 | 357 | Ba | A | B |
| A-5 | 3.5 | 4.7 | 0 | 0 | 0.44 | 240 | Ba | — | C |
| A-6 | 3.5 | 5.2 | 0 | 0 | 0.56 | 340 | Ba | A | B |
| A-7 | 3.2 | 5.2 | 1 | 1 | 0.75 | 355 | Ba | A | A |
| A-8 | 3.2 | 5.2 | 2 | 1 | 0.81 | 360 | Ba | A | A |
| A-9 | 3.2 | 5.2 | 3 | 1 | 0.39 | 234 | Bb | B | A |
| A-10 | 3.4 | 4.9 | 1 | 1 | 0.58 | 288 | Ba | A | C |
| A-11 | 3.4 | 4.9 | 2 | 1 | 0.65 | 275 | Ba | A | B |
| A-12 | 3.4 | 4.9 | 3 | 1 | 0.72 | 280 | Ba | A | A |
| A-13 | 3.2 | 5.2 | 1 | 2 | 0.70 | 351 | Ba | A | A |
| A-14 | 3.2 | 5.2 | 2 | 2 | 0.80 | 348 | Ba | A | A |
| A-15 | 3.2 | 5.2 | 3 | 2 | 0.83 | 363 | Ba | A | A |
| A-16 | 3.4 | 4.9 | 1 | 2 | 0.53 | 287 | Ba | A | C |
| A-17 | 3.4 | 4.9 | 2 | 2 | 0.61 | 274 | Ba | A | B |

TABLE 1-continued

| No. | End Portion Diameter Ddb (mm) | Base Diameter Dda (mm) | End Portion Length Ds1 (mm) | Base Length Ds2 (mm) | Ratio L2/L1 | Bending Test Breaking Load (N) | Bending Test Broken Portion | Bending Test Evaluation | Vibration Test Evaluation |
|---|---|---|---|---|---|---|---|---|---|
| A-18 | 3.4 | 4.9 | 3 | 2 | 0.71 | 279 | Ba | A | A |
| A-19 | 3.2 | 5.2 | 1 | 3 | 0.69 | 360 | Ba | A | B |
| A-20 | 3.2 | 5.2 | 2 | 3 | 0.80 | 351 | Ba | A | A |
| A-21 | 3.2 | 5.2 | 3 | 3 | 0.83 | 362 | Ba | A | A |
| A-22 | 3.4 | 4.9 | 1 | 3 | 0.41 | 279 | Ba | A | C |
| A-23 | 3.4 | 4.9 | 2 | 3 | 0.55 | 282 | Ba | A | C |
| A-24 | 3.4 | 4.9 | 3 | 3 | 0.69 | 291 | Ba | A | C |
| A-25 | 3.0 | 5.2 | 1 | 3 | 0.79 | 368 | Ba | A | A |
| A-26 | 3.0 | 5.2 | 2 | 3 | 0.86 | 359 | Ba | A | A |
| A-27 | 3.0 | 5.2 | 3 | 3 | 0.54 | 220 | Bb | B | A |

Table 1 lists sample Nos., parameters Ddb, Dda, Ds1, Ds2, and L2/L1, which indicate the configurations of the insulators 10, the results of the bending test, and the results of the vibration test. The first evaluation test evaluates 27 types of the samples from No. A-1 to No. A-27 of mutually different configurations of the insulators 10.

Dimensions common to the 27 types of the samples evaluated in the first evaluation test are as follows.

Length of the first outer-diameter-contracted portion 15 (length parallel to the central axis CL): 0.3 mm Diameter d1 of the through hole 12: 1.76 mm Insulator nose length L3: 14 mm In Table 1, the "End Portion Length Ds1=0" indicates the omission of the front cylinder portion 13*fc*. Similarly, the "Base Length Ds2=0" indicates the omission of the rear cylinder portion 13*bc*. As described above, the base length Ds2 is the total value of the length of the first outer-diameter-contracted portion 15 and the length of the rear cylinder portion 13*bc*. The length of first outer-diameter-contracted portion 15 is not zero (0.3 mm). However, for easy understanding of the omission of the rear cylinder portion 13*bc*, Table 1 indicates the base length Ds2 by zero in the case where the rear cylinder portion 13*bc* is omitted.

First, the following describes the bending test. The bending test first installs the spark plug 100 to a test stand (not shown). The test stand has a mounting hole fitting to the thread portion 52 of the metal shell 50. In this state, the insulator 10 is secured at the first position Pa. The front end 10*e*1 of the insulator 10 is a free end. In this state, as shown in FIG. 3 (A), the force W is applied to the second position Pb. The direction of the force W is a direction in the radial direction toward the central axis CL. That is, the direction of the force W is a direction perpendicular to the central axis CL and toward the central axis CL. Then, until the insulator 10 is broken, the force W is strengthened. Such bending test was conducted on ten samples with the identical configuration for each type from No. A-1 to No. A-27.

The "Breaking Load" shown in Table 1 means an average value (an average value of the ten samples) of the strength of the force W at the time point when the insulator 10 was broken (the unit is "newton"). The "Broken Portion" shown in Table 1 is a broken portion of the insulator 10. A "Base Ba" indicates the part near the first position Pa. A "Front End Bb" indicates the part near the second position Pb. The broken portions were the identical among the ten samples with the identical configuration. The evaluation in the bending test was conducted by two stages using the sample No. A-5 as a criterion. Specifically, a first evaluation A indicates that "the breaking load is large compared with the sample No. A-5", and "the broken portion is the base Ba." A second evaluation B indicates that at least one of "the breaking load is small compared with the sample No. A-5" and "the broken portion is the front end Bb" is met.

The broken portion being the front end Bb means that although the base part of the insulator 10 (namely, the part near the first position Pa) is not broken but endures, the front end portion (namely, the part near the second position Pb) is broken. That is, this means that the strength of the front end part of the insulator 10 is locally low. Accordingly, it was determined that the evaluation result of the broken portion being a base Ba was better than the evaluation result of the broken portion being the front end Bb.

The following describes the vibration test. The vibration test of the first evaluation test installed the samples of the spark plugs 100 to tools for vibration test. Under the following conditions, the samples were vibrated in the direction perpendicular to the central axis CL.

Amplitude: 5 mm, frequency: 50 Hz, vibrating time: 1 min

Such vibration test was conducted on ten samples with the identical configuration for each type from No. A-1 to No. A-27. Such vibration test possibly cracks the insulator 10 at the part near the first position Pa. Based on a count of the cracked samples, the evaluation in the vibration test was conducted. Specifically, the first evaluation A indicates that the count of the cracked samples is zero. The second evaluation B indicates that the count of cracked samples is one or more to five or less. A third evaluation C indicates that the count of cracked samples is six or more to ten or less. The above-described conditions for the vibration test are set severely so that the insulator of the conventional spark plug is possibly cracked by the vibration test to make a difference among the plurality of types of samples in the evaluation result.

As shown in Table 1, the 12 types of samples whose ratio (L2/L1) was 0.70 or more (No. A-2, No. A-7, No. A-8, from No. A-12 to No. A-15, No. A-18, No. A-20, No. A-21, No. A-25, and No. A-26) obtained the first evaluation A in both the bending test and the vibration test. Thus, the use of the ratio of 0.70 or more (L2/L1) can reduce the break of the insulator 10. It can be inferred that the wider stable range Rpi allows reducing the break of the insulator 10. Therefore, it can be inferred that as the ratio (L2/L1), various values smaller than 1.0, which is a theoretical maximum value, can be used. The ratio (L2/L1) of the 12 types of samples that obtained good evaluation is: 0.70, 0.71, 0.72, 0.75, 0.78, 0.79, 0.80, 0.81, 0.83, and 0.86. Among these values, any given value can be used as the lower limit of the preferable range (the range equal to or more than the lower limit and equal to or less than the upper limit) of the ratio (L2/L1). Among these values, any given value equal to or more than the lower limit can be used as the upper limit of the preferable range of the ratio (L2/L1).

Regarding the parameters Ddb, Dda, Ds1, and Ds2, as shown in Table 1, good evaluations were obtained with various values. Each parameter Ddb, Dda, Ds1, and Ds2 of the 12 types of samples where good evaluations were obtained is as follows.

End portion diameter Ddb: 2.9, 3.0, 3.2, 3.4 (mm)

Base diameter Dda: 4.9, 5.2 (mm)

End portion length Ds1: 0, 1, 2, 3 (mm)

Base length Ds2: 0, 1, 2, 3 (mm)

The preferable range (the range equal to or more than the lower limit and equal to or less than the upper limit) of the end portion diameter Ddb is as follows. As the lower limit, among these values of the end portion diameter Ddb, any given value can be used. As the upper limit, among these values of the end portion diameter Ddb, any given value equal to or more than the lower limit can be used. Similarly, regarding the other parameters Dda, Ds1, and Ds2, any given value among the above-described values of the 12 types of samples where good evaluations were obtained can be used as the lower limit. Among the above-described values, any given value equal to or more than the lower limit can be used as the upper limit.

The lower limit of the end portion diameter Ddb is not limited to the above-described values. Various values greater than the outer diameter of the part arranged on the inner peripheral side of the second position Pb of the insulator 10 among the center electrode 20 (in this embodiment, the nose portion 25 of the center electrode 20) can be used. With a typical spark plug, as the above-described outer diameter of the center electrode 20, a value within the range of equal to or more 1 mm and equal to or less than 3 mm is used. Therefore, as the lower limit of the end portion diameter Ddb, a value within the range of 1 mm or more and 3 mm or less can be used.

Between the two types of samples of No. A-21 and No. A-27, the end portion diameter Ddb mutually differs; however, the base diameter Dda, the end portion length Ds1, and the base length Ds2 are common. Comparing the results of the bending test among these samples, the No. A-21 whose end portion diameter Ddb is large has large breaking load compared with the No. A-27 whose end portion diameter Ddb is small, and has the broken portion that is not the front end Bb but the base Ba. This reason can be inferred as follows. That is, the larger end portion diameter Ddb can enhance the strength at a part near the second position Pb of the insulator 10. Therefore, the larger end portion diameter Ddb can reduce that the part near the second position Pb is broken although the part near the first position Pa of the insulator 10 is not broken but endures. The tendency similar to the end portion diameter Ddb, the breaking load, and the broken portion can also be confirmed on other samples (for example, No. A-1 and No. A-3).

Between the two types of samples of No. A-19 and No. A-25, the end portion diameter Ddb mutually differs; however, the base diameter Dda, the end portion length Ds1, and the base length Ds2 are common. Comparing the results of the vibration test among these samples, the No. A-25 whose end portion diameter Ddb is small exhibits good evaluation result of the vibration test compared with the No. A-19 whose end portion diameter Ddb is large. This reason can be inferred as follows. That is, the smaller end portion diameter Ddb reduces a weight of the front end portion (namely, the part near the second position Pb) of the insulator 10. Therefore, in the case where the spark plug 100 vibrates, the force that the part near the first position Pa of the insulator 10 receives becomes small as the end portion diameter Ddb becomes small. Consequently, the smaller end portion diameter Ddb can reduce the break of the insulator 10 due to vibration. The tendency similar to the end portion diameter Ddb and the evaluation result of the vibration test can also be confirmed on other samples (for example, No. A-1 and No. A-5).

Typically, compared with the case of concentrating the stress, the case of dispersing the stress is less likely to cause the break. Furthermore, as shown in Table 1, also in the case where the configuration of the insulator 10 (in particular, the configuration of the nose portion 13) variously changes, the use of the ratio (L2/L1) of 0.70 or more allowed obtaining the good evaluation results. Therefore, even if the internal diameter d1 is not 1.76 mm, the above-described preferable range for the ratio (L2/L1) can be inferred as applicable.

C. Second Evaluation Test

The following Table 2 shows configurations of samples of the spark plugs 100 used for the second evaluation test and the evaluation results. To examine an influence of the insulator nose length L3 to durability of the insulator 10, the second evaluation test conducted the bending test and the vibration test on samples of a plurality of types where the insulator nose lengths L3 (FIG. 2) mutually differed. A content and an evaluation method of each test are the identical to the first evaluation test. The bending test selected the sample to be a criterion for the evaluation for each insulator nose length L3.

TABLE 2

| No. | Insulator Nose Length L3 (mm) | End Portion Diameter Ddb (mm) | Base Diameter Dda (mm) | End Portion Length Ds1 (mm) | Base Length Ds2 (mm) | Ratio L2/L1 | Bending Test: Breaking Load (N) | Bending Test: Broken Portion | Bending Test: Evaluation | Vibration Test Evaluation |
|---|---|---|---|---|---|---|---|---|---|---|
| B-1 | 8 | 3.5 | 4.7 | 0 | 0 | 0.43 | 301 | Ba | — | B |
| B-2 | | 3.2 | 5.2 | 2 | 2 | 0.57 | 240 | Bb | B | A |
| B-3 | | 3.4 | 5.2 | 2 | 2 | 0.78 | 380 | Ba | A | A |
| B-4 | | 3.6 | 5.2 | 2 | 2 | 0.74 | 382 | Ba | A | A |
| B-5 | 10 | 3.5 | 4.7 | 0 | 0 | 0.44 | 286 | Ba | — | B |
| B-6 | | 3.2 | 5.2 | 2 | 2 | 0.82 | 369 | Ba | A | A |
| B-7 | | 3.4 | 5.2 | 2 | 2 | 0.79 | 370 | Ba | A | A |
| B-8 | | 3.6 | 5.2 | 2 | 2 | 0.68 | 363 | Ba | A | B |
| B-9 | 12 | 3.5 | 4.7 | 0 | 0 | 0.44 | 266 | Ba | — | C |

TABLE 2-continued

| No. | Insulator Nose Length L3 (mm) | End Portion Diameter Ddb (mm) | Base Diameter Dda (mm) | End Portion Length Ds1 (mm) | Base Length Ds2 (mm) | Ratio L2/L1 | Bending Test Breaking Load (N) | Bending Test Broken Portion | Bending Test Evaluation | Vibration Test Evaluation |
|---|---|---|---|---|---|---|---|---|---|---|
| B-10 | | 3.2 | 5.2 | 2 | 2 | 0.83 | 352 | Ba | A | A |
| B-11 | | 3.4 | 5.2 | 2 | 2 | 0.74 | 345 | Ba | A | A |
| B-12 | | 3.6 | 5.2 | 2 | 2 | 0.64 | 347 | Ba | A | B |
| B-13 | 16 | 3.5 | 4.7 | 0 | 0 | 0.45 | 211 | Ba | — | C |
| B-14 | | 3.2 | 5.2 | 2 | 2 | 0.78 | 305 | Ba | A | A |
| B-15 | | 3.4 | 5.2 | 2 | 2 | 0.70 | 310 | Ba | A | A |
| B-16 | | 3.6 | 5.2 | 2 | 2 | 0.60 | 308 | Ba | A | B |

Similar to Table 1, Table 2 lists the sample Nos., the parameters Ddb, Dda, Ds1, Ds2, and L2/L1, which indicate the configurations of the insulators 10, the results of the bending test, and the results of the vibration test. The second evaluation test evaluates 16 types of the samples from No. B-1 to No. B-16 of mutually different configurations of the insulators 10. The insulator nose length L3 is any of 8, 10, 12, and 16 (mm). The length of the first outer-diameter-contracted portion 15 and the diameter d1 of the through hole 12 are common among the 16 types of samples, and identical to the samples for the first evaluation test.

The 16 types of samples are divided into four groups where the insulator nose length L3 mutually differs. The correspondence relation between the insulator nose length L3, the sample Number, and the criterion for the evaluation of the bending test of each group is as follows.

(First group) Insulator nose length L3=8 mm, from No. B-1 to No. B-4, the criterion is No. B-1.

(Second group) Insulator nose length L3=10 mm, from No. B-5 to No. B-8, the criterion is No. B-5.

(Third group) Insulator nose length L3=12 mm, from No. B-9 to No. B-12, the criteria is No. B-9.

(Fourth group) Insulator nose length L3=16 mm, from No. B-13 to No. B-16, the criteria is No. B-13.

The evaluation method for the bending test is the identical to the evaluation method for the first evaluation test. For example, in the first group, the first evaluation A indicates that "the breaking load is large compared with the sample No. B-1", and "the broken portion is the base Ba." The second evaluation B indicates that at least one of "the breaking load is small compared with the sample No. B-1" and "the broken portion is the front end Bb" is met. Similarly, the evaluations in the bending test are conducted for the other groups using the criterion for each group.

In any groups, the criterion sample omits the front cylinder portion 13*fc* and the rear cylinder portion 13*bc* (the end portion length Ds1=zero and the base length Ds2=zero), the end portion diameter Ddb is 3.5 mm, and the base diameter Dda is 4.7 mm. The other three types of samples have common base diameter Dda (5.2 mm), the end portion length Ds1 (2 mm), and the base length Ds2 (2 mm). The end portion diameter Ddb is 3.2, 3.4, and 3.6.

As shown in Table 2, the eight types of samples whose ratio (L2/L1) was 0.70 or more (No. B-3, No. B-4, No. B-6, No. B-7, No. B-10, No. B-11, No. B-14, and No. B-15) obtained the first evaluation A in both the bending test and the vibration test. Thus, in the case where the insulator nose length L3 is changed as well, the use of the ratio (L2/L1) of 0.70 or more allows reducing the break of the insulator 10.

Generalizing Tables 1 and 2, the ratios (L2/L1) of the 20 types of samples that obtained the first evaluation A in both the bending test and the vibration test were 0.70, 0.71, 0.72, 0.74, 0.75, 0.78, 0.79, 0.80, 0.81, 0.82, 0.83, and 0.86. Among these values, any given value can be used as the lower limit of the preferable range (the range equal to or more than the lower limit and equal to or less than the upper limit) of the ratio (L2/L1). Among these values, any given value equal to or more than the lower limit can be used as the upper limit of the preferable range of the ratio (L2/L1).

Generalizing Tables 1 and 2, regarding the parameters Ddb, Dda, Ds1, Ds2, and L3, good evaluations were obtained with various values. Each parameter Ddb, Dda, Ds1, Ds2, and L3 of the 20 types of samples where the first evaluation A was obtained in both the bending test and the vibration test is as follows.

End portion diameter Ddb: 2.9, 3.0, 3.2, 3.4, 3.5, 3.6 (mm)

Base diameter Dda: 4.7, 4.9, 5.2 (mm)

End portion length Ds1: 0, 1, 2, 3 (mm)

Base length Ds2: 0, 1, 2, 3 (mm)

Insulator nose length L3: 8, 10, 12, 14, 16 (mm)

The preferable range (the range equal to or more than the lower limit and equal to or less than the upper limit) of the end portion diameter Ddb is as follows. As the lower limit, among these values of the end portion diameter Ddb, any given value can be used. As the upper limit, among these values of the end portion diameter Ddb, any given value equal to or more than the lower limit can be used. Similarly, regarding the other parameters Dda, Ds1, Ds2, and L3, any given value among the above-described values of the 20 types of samples where good evaluations were obtained can be used as the lower limit. Among the above-described values, any given value equal to or more than the lower limit can be used as the upper limit. For example, the insulator nose length L3 is preferably 8 mm or more. The insulator nose length L3 is preferably 16 mm or less. It can be inferred that the internal diameter d1 can also use various values different from 1.76 mm.

D. Third Evaluation Test

The following Table 3 shows configurations of samples of the spark plugs 100 used for the third evaluation test and the evaluation results. To examine an influence of the end portion diameter Ddb to the durability of the insulator 10, the third evaluation test conducted the bending test and the vibration test on six types of samples from No. C-1 to No. C-6 whose end portion diameter Ddb mutually differs.

TABLE 3

| No. | End Portion Diameter Ddb (mm) | Base Diameter Dda (mm) | End Portion Length Ds1 (mm) | Base Length Ds2 (mm) | Ratio L2/D1 | Bending Test Breaking Load (N) | Bending Test Broken Portion | Bending Test Evaluation | Vibration Test Evaluation |
|---|---|---|---|---|---|---|---|---|---|
| C-1 | 3.2 | 5.4 | 2.5 | 2.5 | 0.83 | 353 | Ba | A | A |
| C-2 | 3.3 | 5.4 | 2.5 | 2.5 | 0.81 | 349 | Ba | A | A |
| C-3 | 3.4 | 5.4 | 2.5 | 2.5 | 0.79 | 355 | Ba | A | A |
| C-4 | 3.5 | 5.4 | 2.5 | 2.5 | 0.75 | 350 | Ba | A | A |
| C-5 | 3.6 | 5.4 | 2.5 | 2.5 | 0.70 | 343 | Ba | A | B |
| C-6 | 3.7 | 5.4 | 2.5 | 2.5 | 0.64 | 351 | Ba | A | B |

Similar to Table 1, Table 3 lists the sample Nos., the parameters Ddb, Dda, Ds1, Ds2, and L2/L1, which indicate the configurations of the insulators 10, the results of the bending test, and the results of the vibration test. The end portion diameter Ddb is, in the order from No. C-1 to No. C-6, 3.2, 3.3, 3.4, 3.5, 3.6, and 3.7 (mm). The ratio (L2/L1) is, in the order from No. C-1 to No. C-6, 0.83, 0.81, 0.79, 0.75, 0.70, and 0.64. The base diameter Dda (5.4 mm), the end portion length Ds1 (2.5 mm), and the base length Ds2 (2.5 mm) are common to the six types of samples. The insulator nose length L3, the length of the first outer-diameter-contracted portion 15, and the diameter d1 of the through hole 12 are common among the six types of samples, and identical to the samples for the first evaluation test.

The content and the evaluation method of the bending test are the identical to the first evaluation test. The criterion for the evaluation of the bending test is the sample No. A-5 in the above-described Table 1. To make a difference among the plurality of types of samples in the evaluation result, the vibration test was conducted under conditions severer than the conditions for the first evaluation test. Specifically, the amplitude is 8 mm, which is greater than the amplitude of the first evaluation test (5 mm). The frequency (50 Hz) and the vibrating time (1 min) are identical to those for the first evaluation test.

As shown in Table 3, the evaluation results of the bending test were the first evaluation A on all the samples. The evaluation results of the vibration test were the first evaluation A on the four types of samples from No. C-1 to No. C-4 whose end portion diameter Ddb was 3.5 mm or less. The evaluation results were the second evaluation B on the two types of samples No. C-5 and No. C-6 whose end portion diameter Ddb was greater than 3.5 mm. Thus, in the case where the ratio (L2/L1) is 0.70 or more, the use of the end portion diameter Ddb of 3.5 mm or less further allows reducing the break of the insulator 10 due to vibration. This reason can be inferred as follows. In the vibration of the spark plug 100, the small end portion diameter Ddb receives a small force at the part near the first position Pa of the insulator 10 compared with the large end portion diameter Ddb.

As described above, the vibration test in the third evaluation test was conducted under severer conditions than the conditions for the first evaluation test. Accordingly, the following can be inferred. Conducting the vibration test under the conditions identical to the first evaluation test possibly obtaining the first evaluation A even in the case where the end portion diameter Ddb is greater than 3.5 mm.

The base diameter Dda of the sample used for the third evaluation test was 5.4 mm. The use of the base diameter Dda greater than 5.4 mm can enhance the strength of the nose portion 13 against vibration. Therefore, the end portion diameter Ddb of 3.5 mm or less is applicable to the various spark plugs 100 whose base diameter Dda is 5.4 mm or more. Additionally, the following can be inferred. In the case where the base diameter Dda is greater than 5.4 mm, the use of the end portion diameter Ddb of greater than 3.5 mm can also reduce the break of the insulator 10.

E. Fourth Evaluation Test

The following Table 4 shows configurations of samples of the spark plugs 100 used for the fourth evaluation test and the evaluation results. To examine an influence of the end portion length Ds1 to the insulator 10, the fourth evaluation test conducted the bending test on four types of samples from No. D-1 to No. D-4 whose end portion length Ds1 mutually differs.

TABLE 4

| No. | End Portion Diameter Ddb (mm) | Base Diameter Dda (mm) | End Portion Length Ds1 (mm) | Base Length Ds2 (mm) | Ratio L2/L1 | Bending Test Breaking Load (N) | Bending Test Broken Portion | Bending Test Evaluation |
|---|---|---|---|---|---|---|---|---|
| D-1 | 3.2 | 4.9 | 3.4 | 2.5 | 0.79 | 320 | Ba | A |
| D-2 | 3.2 | 4.9 | 3.5 | 2.5 | 0.79 | 318 | Ba | A |
| D-3 | 3.2 | 4.9 | 3.6 | 2.5 | 0.79 | 292 | Bb | B |
| D-4 | 3.2 | 4.9 | 3.7 | 2.5 | 0.79 | 289 | Bb | B |

Table 4 lists sample Nos., the parameters Ddb, Dda, Ds1, Ds2, and L2/L1, which indicate the configurations of the insulators 10, and the results of the bending test. The end portion length Ds1 is, in the order from No. D-1 to No. D-4, 3.4, 3.5, 3.6, and 3.7 (mm). The other parameters Ddb (3.2 mm), Dda (4.9 mm), Ds2 (2.5 mm), and L2/L1 (0.79) are common to the four types of samples. The insulator nose length L3, the length of the first outer-diameter-contracted portion 15 and the diameter d1 of the through hole 12 are common among the four types of samples, and identical to the samples for the first evaluation test.

The content and the evaluation method of the bending test are the identical to the first evaluation test. The criterion for the evaluation of the bending test is the sample No. A-5 in the above-described Table 1. In the fourth evaluation test, the breaking load of all the samples was greater than the criterion breaking load (230 N). Therefore, the first evaluation A indicates that "the broken portion is the base Ba." The second evaluation B indicates that "the broken portion is the front end Bb."

As shown in Table 4, the shorter the end portion length Ds1 was, the larger the breaking load was. Furthermore, the evaluation results of No. D-1 and No. D-2 whose end portion length Ds1 was 3.5 mm or less was the first evaluation A. The evaluation results of the No. D-3 and No. D-4 whose end portion length Ds1 was more than 3.5 mm was the second evaluation B. Thus, the use of the end portion length Ds1 of 3.5 mm or less can reduce the break of the insulator 10 due to force attempting to bend the insulator 10 compared with the case of using the end portion length Ds1 more than 3.5 mm. This reason can be inferred as follows. That is, the outer diameter of the front cylinder portion 13*fc* is smaller than the outer diameters of the other parts 13*t* and 13*bc* of the nose portion 13. Accordingly, the strength of the front cylinder portion 13*fc* is lower than the strength of the other parts 13*t* and 13*bc*. Therefore, it can be inferred that the shorter the length of the front cylinder portion 13*fc*, namely, the shorter the end portion length Ds1 is, the strength of the nose portion 13 can be enhanced.

The end portion diameter Ddb of the sample used for the fourth evaluation test is 3.2 mm. The use of the end portion diameter Ddb greater than 3.2 mm can enhance the strength of the front cylinder portion 13*fc* of the nose portion 13. Therefore, the end portion length Ds1 of 3.5 mm or less is applicable to the various spark plugs 100 whose end portion diameter Ddb is 3.2 mm or more. Additionally, the following can be inferred. In the case where the end portion diameter Ddb is greater than 3.2 mm, the use of the end portion length Ds1 greater than 3.5 mm can also reduce the break of the insulator 10.

F. Fifth Evaluation Test

The following Table 5 shows configurations of samples of the spark plugs 100 used for the fifth evaluation test and the evaluation results. The fifth evaluation test conducted a test for evaluating durability of the insulator 10 against knocking on the internal combustion engine (hereinafter referred to as a "knocking test").

TABLE 5

| No. | End Portion Diameter Ddb (mm) | External Length De (mm) | Projection Area Sp ($mm^2$) | Evaluation |
|---|---|---|---|---|
| E-1 | 3.3 | 1.0 | 3.2 | A |
| E-2 | 3.3 | 1.5 | 4.9 | A |
| E-3 | 3.3 | 2.0 | 6.5 | A |
| E-4 | 3.3 | 2.5 | 8.2 | A |
| E-5 | 3.3 | 3.0 | 9.9 | B |
| E-6 | 3.3 | 3.5 | 11.6 | B |
| E-7 | 3.3 | 4.0 | 13.4 | B |
| E-8 | 3.3 | 4.5 | 15.2 | B |
| E-9 | 3.3 | 5.0 | 17.1 | B |
| E-10 | 3.5 | 2.0 | 6.9 | A |
| E-11 | 3.5 | 2.5 | 8.7 | A |
| E-12 | 3.5 | 3.0 | 10.5 | B |
| E-13 | 3.5 | 3.5 | 12.3 | B |
| E-14 | 3.5 | 4.0 | 14.2 | B |
| E-15 | 3.5 | 4.5 | 16.1 | B |

Figure 5:
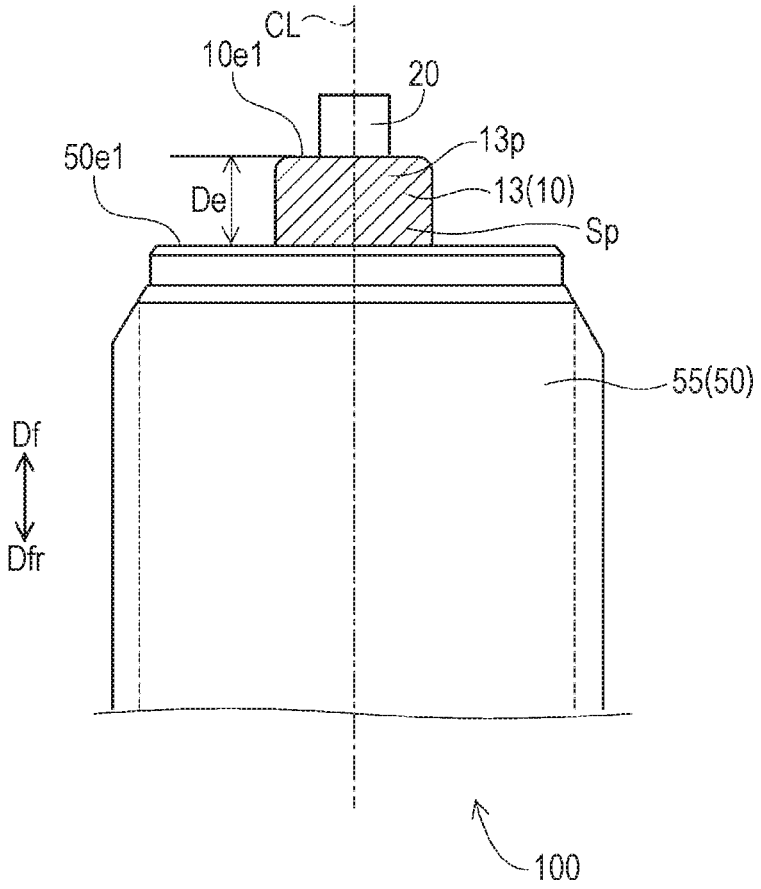
FIG. 5 is an explanatory view of an external length De and a projection area Sp.

Table 5 lists sample Nos., the end portion diameters Ddb, the external lengths De, the projection areas Sp, and the evaluation results of the knocking test. FIG. 5 is an explanatory view of an external length De and a projection area Sp. The drawing shows a part of the front end direction Df side of the spark plug 100 viewed facing the direction perpendicular to the central axis CL.

As shown in the drawing, a part 13*p* on the front end direction Df side of the nose portion 13 of the insulator 10 is arranged on the front end direction Df side with respect to the end (hereinafter referred to as a "front end 50*e*1") on the front end direction Df side of the metal shell 50. This part 13*p* is a part (hereinafter referred to as the "external part 13*p*") arranged outside of the metal shell 50. In the drawing, the external part 13*p* is hatched. The external length De is a length parallel to the central axis CL of the external part 13*p*. In other words, the external length De is a distance between the front end 50*e*1 of the metal shell 50 and the front end 10*e*1 of the insulator 10, and is parallel to the central axis CL.

The projection area Sp is a projection area in the case where the external part 13*p* is projected on a plane (hereinafter referred to as a "projection plane") parallel to the central axis CL along a direction perpendicular to the projection plane (namely, the direction perpendicular to the central axis CL). The area of the hatched region in FIG. 5 corresponds to the projection area Sp.

As shown in Table 5, the knocking test was conducted on 15 types of samples where at least one of the external length De and the projection area Sp mutually differs. The knocking test forcibly generated a knocking on the internal combustion engine to which the sample of the spark plug 100 was installed. Then, whether the insulator 10 was cracked or not was confirmed. Such test was conducted on ten samples with the identical configuration for each type from No. E-1 to No. E-15. The first evaluation A indicates that all the ten samples were not cracked while the second evaluation B indicates that at least one piece of sample was cracked. If the knocking occurs, by a shock wave generated inside the combustion chamber of the internal combustion engine, a force in the direction intersecting with the central axis CL (for example, the direction perpendicular to the central axis CL), like the force W in FIG. 3, is possibly applied to the insulator 10 (the nose portion 13). The force possibly cracks the nose portion 13.

As shown in Table 5, the nine types of samples from No. E-1 to No. E-9 are formed using the insulator 10 with the end portion diameter Ddb of 3.3 mm. The configuration of the insulator 10 is the identical among these nine types of samples. The external length De, furthermore, the projection area Sp is adjusted by changing a position in the direction parallel to the central axis CL of the inner-diameter-contracted portion 56 of the metal shell 50 (FIG. 2). The external length De increases in the order from No. E-1 to No. E-9 and in increments of 0.5 mm from 1.0 mm to 5.0 mm.

The six types of samples from No. E-10 to No. E-15 are formed using the insulator 10 with the end portion diameter Ddb of 3.5 mm. The configuration of the insulator 10 is the identical among these six types of samples. The method for adjusting the external length De, furthermore, the projection area Sp is the identical to the method for the samples from No. E-1 to No. E-9. The external length De increases in the order from No. E-10 to No. E-15 and in increments of 0.5 mm from 2.0 mm to 4.5 mm.

The 15 types of samples each omit the front cylinder portion 13*fc* and the rear cylinder portion 13*bc* (namely, the end portion length Ds1=zero and the base length Ds2=zero). In each of 15 types of samples, the insulator nose length L3 is 14 mm, the base diameter Dda is 5.2 mm, and the ratio L2/L1 is 0.7 or more.

As shown in Table 5, regardless of the end portion diameter Ddb, the six types of samples whose projection area Sp is 8.7 $mm^2$ or less (No. E-1, No. E-2, No. E-3, No. E-4, No. E-10, and No. E-11) obtained the first evaluation A in the evaluation result of the knocking test. Thus, the use of the projection area Sp of 8.7 $mm^2$ or less can reduce the crack of the insulator 10. This reason is inferred as follows. Compared with the large projection area Sp, the small projection area Sp has the small external part 13*p* of the nose portion 13, that is, a small part to which the force in the direction perpendicular to the central axis CL is possibly applied.

As shown in Table 5, the projection areas Sp of the six types of samples (from No. E-1 to No. E-4, No. E-10, and No. E-11) that obtained the first evaluation A were 3.2, 4.9, 6.5, 6.9, 8.2, and 8.7 ($mm^2$). Among these values, any given value can be used as the lower limit of the preferable range (the range equal to or more than the lower limit and equal to or less than the upper limit) of the projection areas Sp. Among these values, any given value equal to or more than the lower limit can be used as the upper limit of the preferable range of the projection areas Sp.

As the lower limit of the projection area Sp, 0 $mm^2$ can be used. The projection area Sp being 0 $mm^2$ means that when viewing the spark plug 100 facing the direction perpendicular to the central axis CL, the entire nose portion 13 is hidden in the through hole 59 of the metal shell 50. In case of knocking, the use of such configuration can reduce the application of the force in the direction perpendicular to the central axis CL to the nose portion 13. This allows reducing the crack of the nose portion 13.

The base diameter Dda of the sample used for the fifth evaluation test is 5.2 mm. The use of the base diameter Dda greater than 5.2 mm can enhance the durability of the nose portion 13. Therefore, the projection area Sp of 8.7 $mm^2$ or less is applicable to the various spark plugs 100 whose base diameter Dda is 5.2 mm or more. Additionally, the following can be inferred. In the case where the base diameter Dda is greater than 5.2 mm, the use of the projection area Sp greater than 8.7 $mm^2$ can also reduce the breaking of the insulator 10.

G. Sixth Evaluation Test

Figure 6:
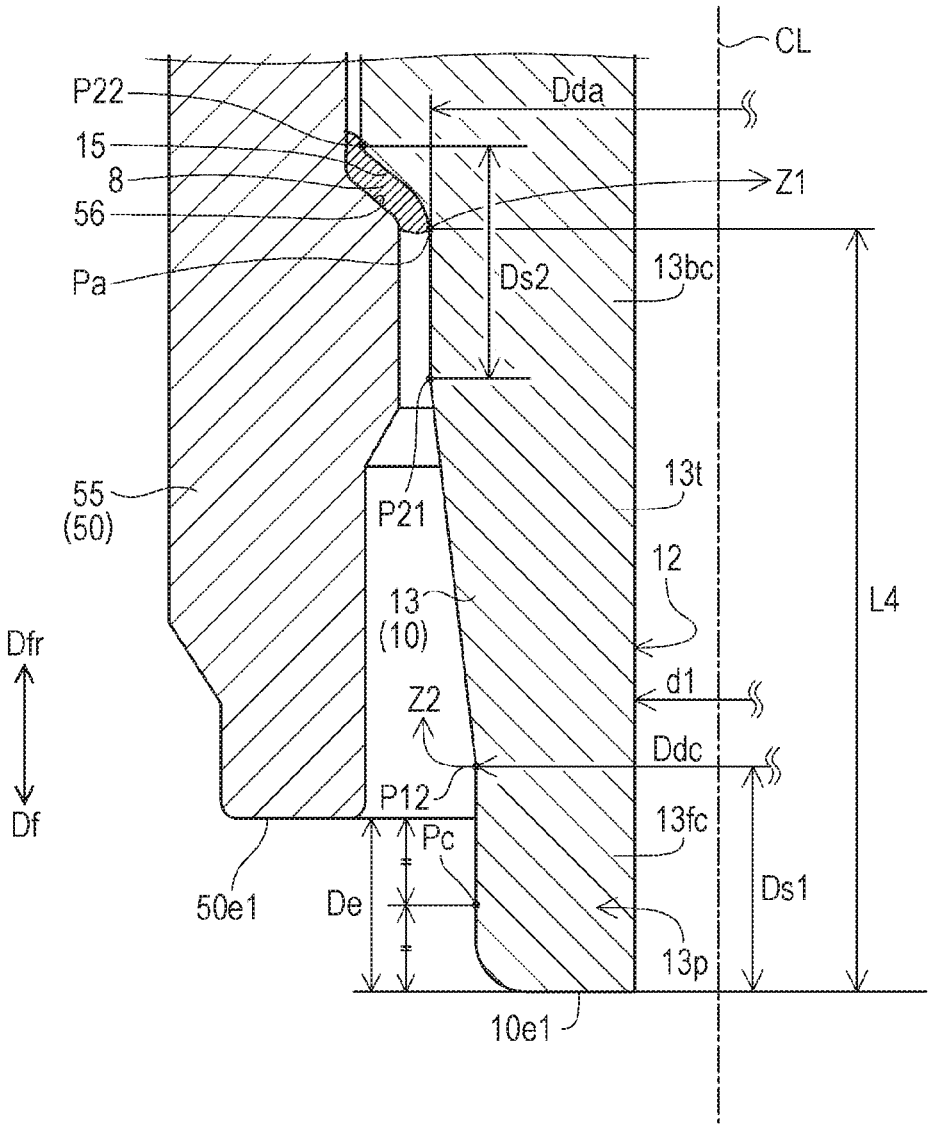
FIG. 6 is an explanatory view showing a configuration of the insulator 10.

G-1. Outline of Test:

FIG. 6 is an explanatory view showing the configuration of the insulator 10. FIG. 6 shows a plurality of parameters including parameters Dda, Ddc, Ds1, De, L4, d1, Pc, Z1, and Z2 used for describing the sixth evaluation test. Among these parameters, Dda, Ds1, and d1 are the identical to the parameters with the identical reference numerals shown in FIG. 2. For example, the internal diameter d1 is an internal diameter at a part on the front end direction Df side of the through hole 12 of the insulator 10. The external length De (hereinafter also referred to as an "exposed length De") is the identical to the external length De shown in FIG. 5. The outer diameter Ddc is the outer diameter of the insulator 10 at the rear end P12 (referred to as a "front base P12") of the front cylinder portion 13*fc*. Hereinafter, the end portion diameter Ddb in FIG. 2 is referred to as a "first end portion diameter Ddb" and the outer diameter Ddc in FIG. 6 is also referred to as a "second end portion diameter Ddc." In this embodiment, the second end portion diameter Ddc is approximately identical to the first end portion diameter Ddb. The fourth length L4 is a length from the first position Pa to the front end 10*e*1 of the insulator 10 and is parallel to the axial line CL. Hereinafter, the insulator nose length L3 in FIG. 2 is referred to as a "first insulator nose length L3", and the fourth length L4 in FIG. 6 is also referred to as the "second insulator nose length L4." A third position Pc is a position bisecting a length De among positions on the surface of the external part 13*p* of the insulator 10. The length De is a length in the direction parallel to the axial line CL of the external part 13*p*. The first section modulus Z1 is a section modulus of the insulator 10 at the first position Pa. The second section modulus Z2 is a section modulus of the insulator 10 at the front base P12. The section moduli Z1 and Z2 can be calculated by the above-described calculating formula (1C). In this embodiment, the internal diameter d1 is the identical across the entire range from the first position Pa to the front base P12.

The following describes the sixth evaluation test using samples of the spark plugs 100. The sixth evaluation test evaluated the "breaking resistance" and the "anti-fouling characteristics or performance" of the insulator 10. The following Table 6 shows the configurations of the samples and the evaluation results.

TABLE 6

| No. | Base Diameter Dda (mm) | End Portion Diameter Ddc (mm) | Internal Diameter d1 (mm) | Ratio Z1/Z2 | End Portion Length Ds1 (mm) | Exposed Length De (mm) | Breaking Resistance | Anti-Fouling Characteristics or Performance |
|---|---|---|---|---|---|---|---|---|
| F-1 | 5.2 | 4 | 2.16 | 2.33 | 1.5 | 0.5 | A | B |
| F-2 | 5.2 | 3.7 | 2.16 | 3.05 | 1.5 | 0.5 | A | B |
| F-3 | 5.2 | 3.5 | 1.96 | 3.56 | 1.5 | 0.5 | A | A |
| F-4 | 5.2 | 3.3 | 1.76 | 4.20 | 1.5 | 0.5 | A | A |
| F-5 | 5.2 | 4 | 2.16 | 2.33 | 2.5 | 1.5 | A | B |
| F-6 | 5.2 | 3.7 | 2.16 | 3.05 | 2.5 | 1.5 | A | A |
| F-7 | 5.2 | 3.5 | 1.96 | 3.56 | 2.5 | 1.5 | A | A |
| F-8 | 5.2 | 3.3 | 1.76 | 4.20 | 2.5 | 1.5 | A | A |
| F-9 | 5.2 | 4 | 2.16 | 2.33 | 3.5 | 1.5 | A | B |
| F-10 | 5.2 | 3.7 | 2.16 | 3.05 | 3.5 | 1.5 | A | A |
| F-11 | 5.2 | 3.5 | 1.96 | 3.56 | 3.5 | 1.5 | A | A |

TABLE 6-continued

| No. | Base Diameter Dda (mm) | End Portion Diameter Ddc (mm) | Internal Diameter d1 (mm) | Ratio Z1/Z2 | End Portion Length Ds1 (mm) | Exposed Length De (mm) | Breaking Resistance | Anti-Fouling Characteristics or Performance |
|---|---|---|---|---|---|---|---|---|
| F-12 | 5.2 | 3.3 | 1.76 | 4.20 | 3.5 | 1.5 | A | A |
| F-13 | 5.2 | 4 | 2.16 | 2.33 | 4.5 | 1.5 | A | A |
| F-14 | 5.2 | 3.7 | 2.16 | 3.05 | 4.5 | 1.5 | A | A |
| F-15 | 5.2 | 3.5 | 1.96 | 3.56 | 4.5 | 1.5 | A | A |
| F-16 | 5.2 | 3.3 | 1.76 | 4.20 | 4.5 | 1.5 | A | A |
| F-17 | 5.2 | 4 | 2.16 | 2.33 | 5.5 | 1.5 | A | A |
| F-18 | 5.2 | 3.7 | 2.16 | 3.05 | 5.5 | 1.5 | A | A |
| F-19 | 5.2 | 3.5 | 1.96 | 3.56 | 5.5 | 1.5 | B | A |
| F-20 | 5.2 | 3.3 | 1.76 | 4.20 | 5.5 | 1.5 | B | A |
| F-21 | 5.2 | 4 | 2.16 | 2.33 | 6.5 | 1.5 | A | A |
| F-22 | 5.2 | 3.7 | 2.16 | 3.05 | 6.5 | 1.5 | B | A |
| F-23 | 5.2 | 3.5 | 1.96 | 3.56 | 6.5 | 1.5 | B | A |
| F-24 | 5.2 | 3.3 | 1.76 | 4.20 | 6.5 | 1.5 | B | A |
| F-25 | 5.2 | 4 | 2.16 | 2.33 | 7.5 | 1.5 | B | A |
| F-26 | 5.2 | 3.7 | 2.16 | 3.05 | 7.5 | 1.5 | B | A |
| F-27 | 5.2 | 3.5 | 1.96 | 3.56 | 7.5 | 1.5 | B | A |
| F-28 | 5.2 | 3.3 | 1.76 | 4.20 | 7.5 | 1.5 | B | A |

Table 6 lists sample Nos., the parameters Dda, Ddc, d1, Z1/Z2, Ds1, and De, which indicate the configurations of the insulator 10, the evaluation results of the breaking resistance, and the evaluation results of the anti-fouling characteristics or performance. The sixth evaluation test evaluates 28 types of the samples from No. F-1 to No. F-28 of mutually different configurations of the insulators 10. The base diameter Dda was common to the all samples, 5.2 mm. The second end portion diameter Ddc was set to any of 3.3, 3.5, 3.7, and 4 (mm). The internal diameter d1 was set to any of 1.76, 1.96, and 2.16 (mm). The ratio Z1/Z2 was any of 2.33, 3.05, 3.56, and 4.20. The end portion length Ds1 was set to any of 1.5, 2.5, 3.5, 4.5, 5.5, 6.5, and 7.5 (mm). The exposed length De was set to any of 0.5 and 1.5 (mm). The 28 types of samples evaluated in the sixth evaluation test had the second insulator nose length L4 of 14 mm and the base length Ds2 of 2.5 mm. Regarding the ratio L2/L1, the samples having the ratio L2/L1 of 0.7 or more were six types, No. F-4, No. F-7, No. F-8, No. F-10, No. F-11, and No. F-14. The adjustment of the exposed length De with the second insulator nose length L4 fixed was performed by adjusting a position in the direction parallel to the axial line CL of the inner-diameter-contracted portion 56 of the metal shell 50.

The breaking resistance was evaluated by conducting the above-described vibration test in the first evaluation test under severer conditions. Specifically, the amplitude was increased from 5 mm to 10 mm. Other conditions on the vibration test are the identical to the conditions on the vibration test in the first evaluation test. Such vibration test was conducted on five samples for each type from No. F-1 to No. F-28. The vibration test under such severe conditions broke off the insulator 10. The breaking position was any of a part near the first position Pa (FIG. 6) and a part near the front base P12. The nose portion 13 of the insulator 10 is supported to the metal shell 50 at the first position Pa via the front-end-side packing 8. Accordingly, the vibration test is likely to break off the insulator 10 at the part near the first position Pa. Here, the breakage not at the part near the first position Pa but at the part near the front base P12 means that strength at the part near the front base P12 is locally low. Therefore, an evaluation result obtained when meeting the evaluation condition "among the five samples, a count of samples broken off near the first position Pa is greater than a count of samples broken off near the front base P12" was determined as the first evaluation A. An evaluation result not meeting the evaluation condition was determined as the second evaluation B.

The anti-fouling characteristics or performance was evaluated by a test run, which will be described later. First, on a chassis dynamometer in a low-temperature test room set to Celsius −15 degrees, a vehicle with four-cylinder engine at a displacement of 0.66 L was prepared. To this engine of the vehicle, the sample of the spark plug 100 was assembled. Then, a driving cycle was repeated. The driving cycle performs a first running pattern, which will be described later, natural cooling by engine stop, and a second running pattern, which will be described later, in this order as one cycle. Here, each time that the one-time driving cycle was ended, a resistance meter of the spark plug 100 was measured. An insulation resistance is an electrical resistance between the terminal metal fitting 40 and the metal shell 50. Then, the test was ended by a condition of declining the resistance meter to 100 MΩ or less. If the count of cycles at the end of the test was five cycles or less, the evaluation result was determined as the second evaluation B. When the count of cycles at the end of the test exceeded five cycles, the evaluation result was determined as the first evaluation A.

The above-described first running pattern is as follows. After racing the engine three times, the gear is set to the third speed and the vehicle runs at a speed of 35 km/h for 40 seconds. After a 90-second idling, the vehicle runs again with the gear at the third speed at 35 km/h for 40 seconds.

The above-described second running pattern races three times and then repeats the running and the engine stop. This running was repeated three times. The one-time running was performed with the gear at the first speed and at 15 km/h for 20 seconds. The engine stop was performed for 30 seconds. After the second running pattern, the engine was stopped. Then, the first running pattern in the next cycle was performed.

Repeating the above-described driving cycle drops the resistance meter. This reason is as follows. Due to fouling (for example, accumulation of carbon to the surface of the insulator 10) in the insulator 10 in association with burning inside the combustion chamber, an electrical resistance using a route passing through from the center electrode 20 to the surface of the insulator 10 and reaching the metal shell 50 drops. Such fouling induces a lateral spark. The lateral spark is a discharge passing through from the center electrode 20 to the surface of the insulator 10 and reaching the metal shell 50. Such lateral spark is likely to occur in the part near the front end 50*e*1 of the metal shell 50. Improving the anti-fouling characteristics or performance can reduce a decline of the electrical resistance at the surface of the insulator 10. Therefore, improving the anti-fouling characteristics or performance can reduce the lateral spark.

As shown in Table 6, all the 28 types of samples obtained the first evaluation A in at least one of the breaking resistance and the anti-fouling characteristics or performance. No sample obtained the second evaluation B on both the breaking resistance and the anti-fouling characteristics or performance.

Figure 7:
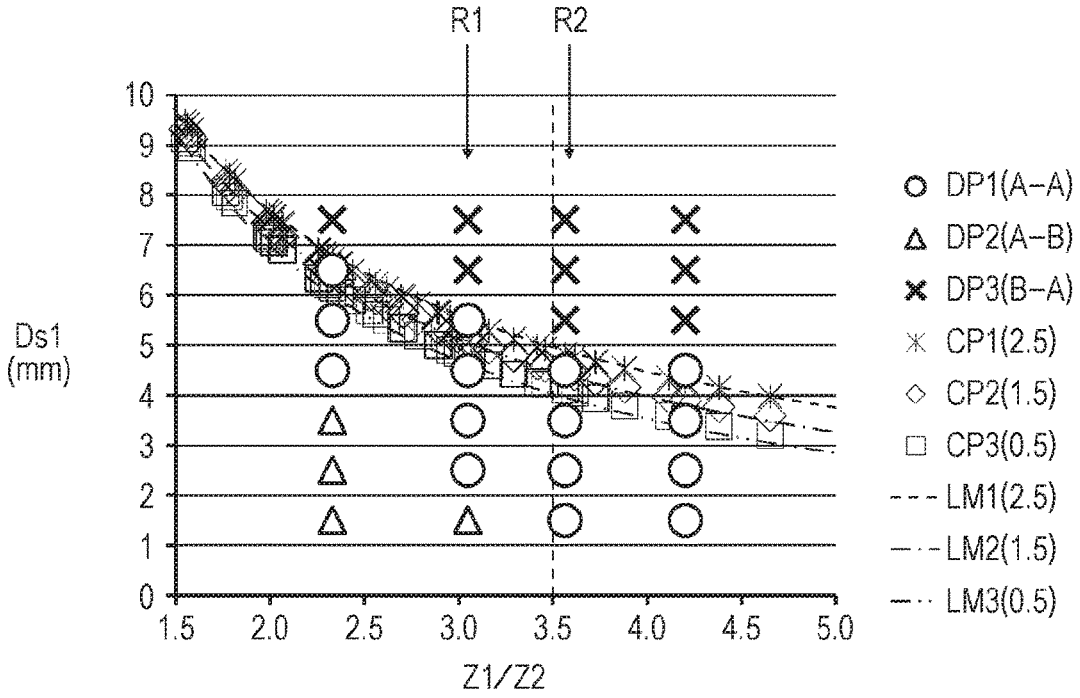
FIG. 7 is a graph showing results of an evaluation test.

FIG. 7 is a graph showing results of the evaluation test listed in Table 6. The horizontal axis indicates the ratio Z1/Z2 while the perpendicular axis indicates the end portion length Ds1. A first type measurement point DP1 shown by the circle mark indicates that a sample obtained the first evaluation A in both the breaking resistance and the anti-fouling characteristics or performance. A second type measurement point DP2 shown by the triangular mark indicates that a sample obtained the first evaluation A in the breaking resistance and the second evaluation B in the anti-fouling characteristics or performance. A third type measurement point DP3 shown by the cross mark indicates a sample that obtained the second evaluation B in the breaking resistance and the first evaluation A in the anti-fouling characteristics or performance.

G-2. Anti-Fouling Characteristics or Performance:

As shown in the drawing, in the case where the end portion length Ds1 is constant, increasing the ratio Z1/Z2 improved the anti-fouling characteristics or performance (refer to the first type measurement point DP1 and the second type measurement point DP2). This reason is inferred as follows. As shown in the above-described calculating formula (1C), the section modulus becomes large as the outer diameter increases. Therefore, if the ratio Z1/Z2 is large, the ratio of the second section modulus Z2 to the first section modulus Z1 is small. That is, the ratio of the outer diameter Ddc at the front base P12 to an outer diameter Dda at the first position Pa is small. If the ratio of the outer diameter Ddc at the front base P12 is small, a volume of the front end portion of the insulator 10 is small. Accordingly, in association with burning inside the combustion chamber, a temperature at the front end portion of the insulator 10 is likely to increase. Therefore, even if a carbon accumulates at the surface of the front end portion of the insulator 10, the carbon can be easily burnt through. As a result, it is inferred that the larger ratio Z1/Z2 improves the anti-fouling characteristics or performance.

As shown in Table 6 and FIG. 7, the ratio Z1/Z2 at which the first evaluation A was achieved in the anti-fouling characteristics or performance regardless of the end portion length Ds1 was two values, 3.56 and 4.20. Among these two values, any selected value may be used as the lower limit of the preferable range (equal to or more than the lower limit and equal to or less than the upper limit) of the ratio Z1/Z2. For example, as the ratio Z1/Z2, a value 3.56 or more may be used. As the upper limit of the preferable range of the ratio Z1/Z2, among the above-described two values, any given value equal to or more than the lower limit may be used. For example, as the ratio Z1/Z2, a value 4.20 or less may be used. As described above, it is inferred that the larger ratio Z1/Z2 improves the anti-fouling characteristics or performance. Accordingly, it is inferred that as the ratio Z1/Z2, a value larger than 4.20 can be used. For example, as the ratio Z1/Z2, a value equal to or less than a practical upper limit (for example, 6.0 or less) may be used.

As shown by, for example, No. F-2, a maximum value R1 among the ratio Z1/Z2 of the samples having the anti-fouling characteristics or performance with the second evaluation B (FIG. 7: second type measurement point DP2) was 3.05 (hereinafter referred to as the "first ratio R1"). As shown by, for example, No. F-3, a minimum value R2 (FIG. 7) among the ratio Z1/Z2 achieving the anti-fouling characteristics or performance with the first evaluation A was 3.56 (hereinafter referred to as the "second ratio R2") regardless of the end portion length Ds1. Therefore, it is inferred that regardless of the end portion length Ds1, the lower limit of the ratio Z1/Z2 at which the anti-fouling characteristics or performance with the first evaluation A is achievable is smaller than 3.56 (the second ratio R2) and is greater than 3.05 (the first ratio R1). For example, it can be inferred that as the ratio Z1/Z2, a value larger than a value (for example, 3.5) between the first ratio R1 (3.05) and the second ratio R2 (3.56) can be used.

In the case where the ratio Z1/Z2 is constant, lengthening the end portion length Ds1 improved the anti-fouling characteristics or performance (refer to the first type measurement point DP1 and the second type measurement point DP2). This reason is inferred as follows. In the case where the end portion length Ds1 is long, since the front cylinder portion 13*fc* is long, the volume of the front end portion of the insulator 10 is small. Accordingly, in association with burning inside the combustion chamber, a temperature at the front end portion of the insulator 10 is likely to increase. Therefore, even if a carbon accumulates at the surface of the front end portion of the insulator 10, the carbon can be easily burnt through. It is inferred that this results in improving the anti-fouling characteristics or performance.

In the case where the ratio Z1/Z2 is the first ratio R1 (3.05), as shown by No. F-2, the anti-fouling characteristics or performance of the end portion length Ds1 at 1.5 mm was the second evaluation B. As shown by No. F-6, the anti-fouling characteristics or performance of the end portion length Ds1 at 2.5 mm was the first evaluation A. In the case where the ratio Z1/Z2 is the second ratio R2 (3.56), as shown by No. F-3 and No. F-7, both the end portion length Ds1 at 1.5 mm and the end portion length Ds1 at 2.5 mm achieved the first evaluation A in the anti-fouling characteristics or performance. Therefore, assume the case where the ratio Z1/Z2 is greater than a value (for example, 3.5) between the first ratio R1 (3.05) and the second ratio R2 (3.56). It is inferred that the use of a value greater than a value (for example, 2 mm) between 1.5 mm and 2.5 mm as the end portion length Ds1 can achieve the anti-fouling characteristics or performance with the first evaluation A.

As shown in Table 6 and FIG. 7, even if the ratio Z1/Z2 is the second ratio R2 (3.56), furthermore, is smaller than 3.5, lengthening the end portion length Ds1 was able to achieve the anti-fouling characteristics or performance with the first evaluation A. Thus, the ratio Z1/Z2 may be smaller than 3.5. Even if the end portion length Ds1 is 2 mm or less, increasing the ratio Z1/Z2 was able to achieve the anti-fouling characteristics or performance with the first evaluation A. Thus, the end portion length Ds1 may be 2 mm or less. As shown in FIG. 7, assume the case where Z1/Z2>3.5 and Ds1>2 mm. Adjusting the ratio Z1/Z2 and the end portion length Ds1 can achieve the breaking resistance with the first evaluation A in addition to the anti-fouling characteristics or performance with the first evaluation A. The following describes the relation between the ratio Z1/Z2 and the end portion length Ds1 while focusing on the breaking resistance.

G-3. Breaking Resistance:

In the case where the end portion length Ds1 is constant, decreasing the ratio Z1/Z2 improved the breaking resistance (refer to the first type measurement point DP1 and the third type measurement point DP3 in FIG. 7). This reason is inferred as follows. As shown in the above-described calculating formula (1C), the section modulus becomes large as the outer diameter increases. Therefore, if the ratio Z1/Z2 is large, the ratio of the second section modulus Z2 to the first section modulus Z1 is small. That is, the ratio of the outer diameter Ddc at the front base P12 to the outer diameter Dda at the first position Pa is small. Consequently, it is inferred that compared with the strength at the first position Pa, the strength at the front base P12 is reduced.

In the case where the ratio Z1/Z2 is constant, shortening the end portion length Ds1 improved the breaking resistance (refer to the first type measurement point DP1 and the third type measurement point DP3). This reason is inferred as follows. The short end portion length Ds1 has a small part (the external part 13*p*) on the front end direction Df side with respect to the front base P12 compared with the long end portion length Ds1. Accordingly, the stress at the front base P12 is small during the vibration. Thus, to reduce the breakage near the front base P12, shortening the end portion length Ds1 is preferable.

The outer diameter of the insulator 10 gradually increases from the front base P12 toward a rear end direction Dfr2. That is, the shortest distance between the position on the surface of the insulator 10 and the metal shell 50 gradually shortens from the front base P12 toward the rear end direction Dfr2. Therefore, in the case where the front base P12 is close to the front end 50*e*1 of the metal shell 50, since a distance between the front end 50*e*1 of the metal shell 50 and the insulator 10 (in particular, a part on the rear end direction Dfr2 side from the front base P12) becomes short, the lateral spark is likely to occur. Here, in the case where the second insulator nose length L4 is constant, lengthening the end portion length Ds1 can keep the front base P12 away of the front end 50*e*1 of the metal shell 50 to the rear end direction Dfr2 side. It is inferred that this consequently reduces the lateral spark.

G-4. Relation Between End Portion Length Ds1 and Ratio Z1/Z2:

In the case where the ratio Z1/Z2 is constant, the maximum value of the end portion length Ds1 at which the breaking resistance with the first evaluation A is achievable becomes large as the ratio Z1/Z2 decreases (refer to the first type measurement point DP1 and the third type measurement point DP3 in FIG. 7). The following describes the relation between the maximum value of the end portion length Ds1 and the ratio Z1/Z2. The graph of FIG. 7 shows three types of calculation points CP1, CP2, and CP3. These calculation points CP1, CP2, and CP3 indicate combinations of the end portion length Ds1 and the ratio Z1/Z2 in the case where stress at the front base P12 (FIG. 6) is identical to stress at the first position Pa. The stress is a calculated value when applying a load perpendicular to the axial line CL to the third position Pc on the surface of the insulator 10 (hereinafter, the third position Pc is also referred to as the "load position Pc") with the insulator 10 to the metal shell 50 being secured. The stress can be calculated in accordance with the above-described calculating formulas (1A) to (1C). The first type calculation point CP1 indicates the exposed length De being 2.5 mm. The second type calculation point CP2 indicates the exposed length De being 1.5 mm. The third type calculation point CP3 indicates the exposed length De being 0.5 mm. The other parameters are as follows.

Second insulator nose length L4: fixed at 14 mm.

Base diameter Dda: any of 4.6, 4.8, 5.0, and 5.2 (mm)

Second end portion diameter Ddc: any of 3.3, 3.5, 3.7, and 4.0 (mm)

Internal diameter d1: any of 1.76, 1.96, and 2.16 (mm)

The plurality of first type calculation points CP1 in the graph of FIG. 7 indicates 48 calculation points. The 48 calculation points were calculated from 48 combinations of the above-described four base diameters Dda, four second end portion diameters Ddc, and three internal diameters d1. The plurality of second type calculation points CP2 and the plurality of third type calculation points CP3 each indicate 48 calculation points calculated from 48 combinations of the parameters Dda, Ddc and d1, similarly. The graph of FIG. 7 shows the measured points DP1, DP2, and DP3 without differentiating the exposed length De.

Here, the following describes the relation between the end portion length Ds1 and the calculation points CP1, CP2, and CP3 in the case where the ratio Z1/Z2 is constant. When the end portion length Ds1 is identical to the calculation points CP1, CP2, and CP3 with the identical exposed length De, as described above, the stress at the front base P12 is identical to the stress at the first position Pa.

Assume the case where the end portion length Ds1 was set smaller than the calculation points CP1, CP2, and CP3 of the identical exposed length De (the other parameters are not changed). Then, the distance between the front base P12 and the load position Pc becomes short, decreasing the stress at the front base P12. On the other hand, the distance between the first position Pa and the load position Pc does not change; therefore, the stress at the first position Pa does not change. Due to the above-described circumstances, the stress at the front base P12 becomes smaller than the stress at the first position Pa. Therefore, it is inferred that a possibility of a breakage near the first position Pa is greater than a possibility of a breakage near the front base P12. Here, the graph of FIG. 7 compares the calculation points CP1, CP2, and CP3 and the measured points DP1, DP2, and DP3. As shown in the drawing, the breaking resistance of the samples with the end portion length Ds1 smaller than the calculation points CP1, CP2, and CP3 obtained the first evaluation A (refer to the first type measurement point DP1).

Inversely, assume that the end portion length Ds1 is set larger than the calculation points CP1, CP2, and CP3 with the identical exposed length De (the other parameters are not changed). Then, since the distance between the front base P12 and the load position Pc is long, the stress at the front base P12 increases. On the other hand, since the distance between the first position Pa and the load position Pc does not change, the stress at the first position Pa does not change. As described above, the stress at the front base P12 is larger than the stress at the first position Pa. Accordingly, it is inferred that the possibility of breakage near the front base P12 is greater than the possibility of breakage near the first position Pa. Here, in the graph of FIG. 7, the calculation points CP1, CP2, and CP3 are compared with the measured points DP1, DP2, and DP3. As shown in the drawing, the end portion lengths Ds1 of the third type measurement points DP3 at which the breaking resistance was the second evaluation B were all greater than the calculation points CP1, CP2, and CP3.

As described above, the end portion length Ds1 calculated under the condition that the stress at the front base P12 is the identical to the stress at the first position Pa can be used as an upper limit value of the end portion length Ds1 to achieve good breaking resistance. Here, approximating the plurality of calculation points CP1, CP2, and CP3 by the function of the ratio Z1/Z2 derives an approximation formula calculating an upper limit value Ds1L of the end portion length Ds1 from the ratio Z1/Z2. As shown in the following, the upper limit value Ds1L will be expressed with the power of the ratio Z1/Z2.

$$Ds1L=Ap\times(Z1/Z2)^{Bp}$$

Two parameters Ap and Bp in the approximation formula will be expressed with the linear function using the second insulator nose length L4 and the exposed length De as described below.

$$Ap=a1+a2\times L4+a3\times De$$

$$Bp=b1+b2\times L4+b3\times De$$

These six parameters a1, a2, a3, b1, b2, and b3 in the two linear functions are determined such that the upper limit value Ds1L calculated by the approximation formula approximates the plurality of calculation points. Here, as the plurality of calculation points, in addition to the plurality of calculation points CP1, CP2, and CP3 shown in FIG. 7, the 48 calculation points obtained by changing the second insulator nose length L4 to 12 mm and the 48 calculation points obtained by changing the second insulator nose length L4 to 8 mm were used for the approximation. A least squares method was used for the approximation method. This approximation derived the following calculating formulas as the calculating formulas for the parameters Ap and Bp.

$$Ap=0.07+0.986\times L4-0.268\times De$$

$$Bp=-0.832-0.014\times L4+0.099\times De$$

Each approximated curve LM1, LM2, and LM3 shown in the graph of FIG. 7 is an approximated curve expressed by the above-described approximation formula in the case where the exposed length De is 2.5 mm, 1.5 mm, and 0.5 mm. As shown in the drawing, the first approximated curve LM1 appropriately approximates the plurality of first type calculation points CP1. The second approximated curve LM2 appropriately approximates the plurality of second type calculation points CP2. The third approximated curve LM3 appropriately approximates the plurality of third type calculation points CP3. Then, the breaking resistance of the sample whose end portion length Ds1 was smaller than the upper limit value Ds1L indicated by the approximated curve was the first evaluation A. Furthermore, the end portion length Ds1 of the sample whose breaking resistance was the second evaluation B was greater than the upper limit value Ds1L indicated by the approximated curve. Thus, the end portion length Ds1 was set to the value smaller than the upper limit value Ds1L calculated in accordance with the approximation formula, allowing improving the breaking resistance.

The above-described approximation formula for calculating the upper limit value Ds1L is determined based on the logic "In the case where the stress at the front base P12 is smaller than the stress at the first position Pa, since the breakage near the front base P12 can be reduced, the breaking resistance can be improved." This logic is thought to be met regardless of the configurations of the insulator 10 (for example, the second insulator nose length L4, the base diameter Dda, the first end portion diameter Ddb, the second end portion diameter Ddc, the internal diameter d1, the exposed length De, the first section modulus Z1, the second section modulus Z2, the ratio Z1/Z2, the first length L1, the ratio L2/L1, and the projection area Sp). Therefore, it is inferred that the above-described approximation formula for calculating the upper limit value Ds1L is not limited to the samples shown in Table 6. The approximation formula is applicable to the insulator 10 (furthermore, the spark plug 100) with other various configurations. For example, it is inferred that in the case where the second insulator nose length L4 is 12 mm or 8 mm, furthermore, in the case where the second insulator nose length L4 is in the practical range (for example, within the range of 5 mm or more to 20 mm or less), insofar as the end portion length Ds1 is less than the above-described upper limit value Ds1L, the breaking resistance can be improved. Similarly, it is inferred that also in the case where the other parameters (for example, any of the parameters L4, Dda, Ddc, d1, De, Z1, Z2, Z1/Z2, L1, and L2/L1) is outside the range of the values evaluated in the evaluation test of Table 6, insofar as the end portion length Ds1 is less than the above-described upper limit value Ds1L, the breaking resistance can be improved.

Even if the end portion length Ds1 is equal to or more than the upper limit value Ds1L, as long as the strength of the insulator 10 is stronger than the actual stress possibly applied to the insulator 10 in assumed usage environment of the spark plug 100, the breakage of the insulator 10 can be reduced. Therefore, the end portion length Ds1 may be equal to or more than the upper limit value Ds1L.

In any cases, the use of the ratio L2/L1 (for example, the ratio L2/L1 of 0.7 or more) within the preferable range described in Tables 1 and 2 can reduce the break of the insulator 10. The use of the first end portion diameter Ddb (for example, the first end portion diameter Ddb of 3.5 mm or less) within the preferable range described in Table 3 can reduce the break of the insulator 10 due to vibration. Here, the second end portion diameter Ddc is almost identical to the first end portion diameter Ddb. Accordingly, the use of the second end portion diameter Ddc of 3.5 mm or less allows reducing the break of the insulator 10 due to vibration. The use of the end portion length Ds1 (for example, the end portion length Ds1 of 3.5 mm or less) within the preferable range described in Table 4 can reduce the break of the insulator 10. The use of the projection area Sp (for example, the projection area Sp within 8.7 $mm^2$ or less) within the preferable range described in Table 5 allows reducing the crack of the insulator 10. However, at least one of these parameters L2/L1, Ddb, Ddc, Ds1, and Sp may be outside of the corresponding preferable range.

H. Modification (1) The configuration of the insulator 10 can employ various configurations different from the above-described configurations. Especially, the configuration on the rear end direction Dfr side from the first position Pa in contact with the front-end-side packing 8 can use any given configuration. In any cases, the use of the above-described configurations as the configuration on the front end direction Df side from the first position Pa can reduce the break of the insulator 10.

(2) The configuration of the spark plug 100 can employ various configurations different from the configuration described in FIG. 1. For example, the nominal diameter of thread portion 52 of the metal shell 50 can employ a different nominal diameter from M10 (10 mm). Here, the use of the above-described insulator 10 can decrease the outer diameter of the spark plug 100 while reducing the break of the insulator 10. For example, as the nominal diameter of the thread portion 52, the nominal diameter of equal to or less than M10, for example, the nominal diameter of equal to or more than M6 to equal to or less than M10 (for example, any of M6, M8, and M10) can be used. The use of the nominal diameter of equal to or less than M10 allows thinning the entire spark plug 100, allowing improving a freedom of design of the internal combustion engine.

The resistor 70 may be omitted. The head 23 of the center electrode 20 may be omitted. A gap may be formed between a side surface (that is, the outer peripheral surface) of the center electrode and the ground electrode. A noble metal tip may be disposed at a part where the gap is formed, in the center electrode. The noble metal tip may be disposed at the part where the gap is formed, in the ground electrode. As a material of the noble metal tip, an alloy containing a noble metal, such as iridium and platinum, can be used.

The present invention has been described above based on the embodiments and the modifications. The above-described embodiments of the invention are for ease of understanding of the present invention and do not limit the present invention. The present invention may be modified or improved without departing from the gist and the claims of the present invention, and includes the equivalents.

INDUSTRIAL APPLICABILITY

This disclosure is preferably applicable to a spark plug used for an internal combustion engine or a similar engine.

DESCRIPTION OF REFERENCE SIGNS

5 Gasket
6 First rear end side packing
7 Second rear end side packing
8 Front-end-side packing
9 Talc
10 Insulator (ceramic insulator)
11 Second outer-diameter-contracted portion
12 Through hole (axial hole)
13 Nose portion
13*p* External part
13*t* Tapered portion
13*bc* Rear cylinder portion
13*fc* Front cylinder portion
15 First outer-diameter-contracted portion
16 Inner-diameter-contracted portion
17 Front-end-side trunk portion
18 Rear-end-side trunk portion
19 Collar portion
20 Center electrode
20*s*1 Front end surface
21 Base material
22 Core material
23 Head
24 Collar portion
25 Nose portion
30 Ground electrode
31 Front end portion
35 Base material
36 Core portion
40 Terminal metal fitting
41 Plug cap installation portion
42 Collar portion
43 Nose portion
50 Metal shell
51 Tool engagement portion
52 Thread portion
53 Crimp portion
54 Seat portion
55 Body
56 Inner-diameter-contracted portion
58 Deformed portion
59 Through hole
60 First seal portion
70 Resistor
80 Second seal portion
100 Spark plug
g Gap
CL Central axis (axial line)

Having described the invention, the following is claimed:

1. A spark plug, comprising:

a center electrode extending in an axial line direction;

an insulator that includes an axial hole extending in the axial line direction, the center electrode being arranged at a front end side of the axial hole, the insulator including an outer-diameter-contracted portion and a nose portion, the outer-diameter-contracted portion having an outer diameter decreased toward the front end side in the axial line direction, the nose portion being a part disposed at a front end side of the outer-diameter-contracted portion;

a metal shell arranged at an outer periphery of the insulator, the metal shell including an inner-diameter-contracted portion, the inner-diameter-contracted portion having an internal diameter decreased toward the front end side in the axial line direction; and a packing arranged between the outer-diameter-contracted portion of the insulator and the inner-diameter-contracted portion of the metal shell, wherein assuming that in a contact portion of the packing and the insulator, a position at a most front end side is set as a first position, in a surface of the nose portion of the insulator, a position where a length from a front end of the insulator parallel to the axial line direction is 1 mm is set as a second position, a length between the first position and the second position parallel to the axial line direction is set as a first length, in a case where a load perpendicular to the axial line direction is applied to the second position in a state where the insulator is secured at the first position of the insulator and the front end of the insulator is a free end, a ratio of stress at a surface position that is a position on a surface of the insulator to stress at the first position is set as a stress ratio, and in a range of the surface position where the stress ratio is 0.8 or more to 1.15 or less, a length in a continuous range from the first position toward a front end side parallel to the axial line direction is set as a second length, a ratio of the second length to the first length is 0.7 or more.

2. The spark plug according to claim 1, wherein the insulator has an outer diameter of 3.5 mm or less at the second position.

3. The spark plug according to claim 1 or 2, wherein the nose portion includes a cylinder portion forming a front end side part of the nose portion, the cylinder portion having a constant outer diameter, and a length from a rear end of the cylinder portion to the front end of the insulator parallel to the axial line direction is 3.5 mm or less.

4. The spark plug according to claim 1, wherein a part of the front end side of the nose portion is arranged on a front end side with respect to a front end of the metal shell, and a projection area when projecting a part of the nose portion arranged on a front end side with respect to the front end of the metal shell in a direction perpendicular to the axial line direction is 8.7 $mm^2$ or less.

5. The spark plug according to claim 1, wherein the metal shell includes a thread portion for mounting, and a nominal diameter of the thread portion is M10 or less.

6. The spark plug according to claim 1, wherein the nose portion includes a cylinder portion forming the front end side part of the nose portion, the cylinder portion having a constant outer diameter, the part of the front end side of the nose portion is arranged on the front end side with respect to the front end of the metal shell, and assuming that a length from the rear end of the cylinder portion to the front end of the insulator parallel to the axial line direction is denoted as Ds1, a section modulus of the insulator at the first position is denoted as Z1, a section modulus of the insulator at the rear end of the cylinder portion is denoted as Z2, a length from the first position to the front end of the insulator parallel to the axial line direction is denoted as L4, a length of a part of the nose portion positioned on a front end side with respect to the front end of the metal shell parallel to the axial line direction is denoted as De, following relational expressions (1), (2), and (3) are met, $$Z1/Z2>3.5 \quad (1)$$

$$Ds1>2 \text{ mm} \quad (2)$$

$$Ds1<Ap\times(Z1/Z2)^{Bp} \quad (3)$$

Here, Ap=0.07+0.986×L4−0.268×De

Bp=−0.832−0.014×L4+0.099×De

Units of Ds1, L4, and De are mm.

* * * * *